US006955426B2

(12) United States Patent
Kaga et al.

(10) Patent No.: US 6,955,426 B2
(45) Date of Patent: Oct. 18, 2005

(54) INK JET PRINTER

(75) Inventors: Hikaru Kaga, Ama-gun (JP); Seiji Shimizu, Ogaki (JP); Tsuyoshi Suzuki, Owariasahi (JP); Katsunori Nishida, Nagoya (JP); Takamasa Usui, Ogaki (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 450 days.

(21) Appl. No.: 09/987,410

(22) Filed: Nov. 14, 2001

(65) Prior Publication Data

US 2002/0057320 A1 May 16, 2002

(30) Foreign Application Priority Data

| | | |
|---|---|---|
| Nov. 5, 2000 | (JP) | 2000-347981 |
| Dec. 1, 2000 | (JP) | 2000-367637 |
| Dec. 1, 2000 | (JP) | 2000-367651 |
| Dec. 4, 2000 | (JP) | 2000-368707 |
| Dec. 4, 2000 | (JP) | 2000-368708 |
| Dec. 7, 2000 | (JP) | 2000-372332 |
| Dec. 7, 2000 | (JP) | 2000-372687 |
| Dec. 8, 2000 | (JP) | 2000-374116 |

(51) Int. Cl.[7] ..... B41J 2/19
(52) U.S. Cl. ..... 347/92; 347/35
(58) Field of Search ..... 347/35, 92, 25, 347/93, 84–86

(56) References Cited

U.S. PATENT DOCUMENTS

| | | | | |
|---|---|---|---|---|
| 4,463,362 A | | 7/1984 | Thomas | |
| 4,575,738 A | | 3/1986 | Sheufelt et al. | |
| 5,408,257 A | | 4/1995 | Hiramatsu et al. | |
| 6,286,926 B1 | | 9/2001 | Hirabayashi et al. | |
| 6,290,343 B1 | * | 9/2001 | Lewis et al. | 347/85 |
| 6,478,415 B2 | * | 11/2002 | Barinaga et al. | 347/85 |
| 2002/0001098 A1 | | 1/2002 | Moriyama et al. | |

FOREIGN PATENT DOCUMENTS

| | | |
|---|---|---|
| EP | 1029693 | 8/2000 |
| JP | 57-175912 A | 10/1982 |
| JP | 59-73953 A | 4/1984 |
| JP | 63-44064 B2 | 9/1988 |
| JP | 2887605 B2 | 2/1999 |

* cited by examiner

*Primary Examiner*—Lamson D Nguyen
(74) *Attorney, Agent, or Firm*—Oliff & Berridge, PLC

(57) ABSTRACT

An ink jet printer uses a print head that has at least one ink nozzle and performs printing on a recording medium by ejecting ink from the ink nozzle. An air chamber is connected to the print head to trap air generated in an ink passage. A purge device discharges the air trapped in the air chamber from the ink nozzle. A filter member divides the lower portion of the air chamber into a first chamber and a second chamber. The air chamber traps and stores air in the top portion of the air chamber and the filter member passes ink there through when the print head performs printing. The air trapped in the air chamber is discharged when the purge device generates an ink flow that goes over the filter member.

83 Claims, 25 Drawing Sheets

13e
11b
15
13a
11a
4

11a
18a
311e
13e
311f
11b
11j
15
311d1
18a
13a
4
311d2
311d
11c
11c1

INK JET PRINTER

BACKGROUND OF THE INVENTION

1. Field of Invention

The invention relates to an ink jet printer that performs printing by ejecting ink from a print head and, more particularly, to an ink jet printer of ink tube supply type where ink to be ejected is supplied from an ink tank to a print head through an ink supply tube.

2. Description of Related Art

A conventionally known ink jet printer of ink tube supply type is disclosed in Japanese Laid-Open Patent Publication No. 59-73953.

Such an ink jet printer is designated by the numeral 620 in FIG. 25. FIG. 25 is a perspective view showing the ink jet printer 620 in schematic form. The ink jet printer 620 includes a print head unit 621, a platen roller 622, a carriage 623, an ink tank 624, an ink tube 625, a signal input line 626, and guide rods 627.

The print head unit 621 is equipped with a print head having ink nozzles from which ink is ejected to perform printing onto a paper sheet based on a signal sent via the signal input line 626. The print head unit 621 receives a supply of ink from the ink tank 624 via the ink tube 625. The print head unit 621 is installed on the carriage 623, which is attached to a belt. The belt is looped around a roller attached to a motor. Thus, when the motor runs, the belt is driven, which allows the carriage 623 with the print head unit 621 to move along the guide rods 27 for whatever distance the belt is driven.

The guide rods 627 are slidably inserted into the carriage 623 and support the carriage 623 for movement. Thus, the print head unit 621 installed on the carriage 623 can reciprocate in a direction parallel to the guide rods 627, that is, in both directions along the length of the platen roller 622.

In the ink jet printer of ink tube supply type, when the carriage equipped with the print head performs a printing operation while moving reciprocally, the ink in the ink tube undergoes acceleration, causing pressure waves that propagate in the ink toward the print head. The above-described printer is structured to absorb the pressure waves generated in the ink by placing an air-filled damper between the tubes.

On the other hand, to hold printing quality in the proper condition, the ink jet printer needs to maintain a constant state of ink to be ejected from the ink nozzles. To maintain the state of ink to be ejected, a meniscus (curved surface) is formed on the surface of the ink at the end of each of the ink nozzles. As the meniscus is formed by, for example, causing a negative pressure in the ink to be supplied to the nozzles within a specified range, the pressure to supply the ink is kept constant, always producing the meniscus with the same shape. Thus, the ink to be ejected is maintained under a certain condition.

However, when the pressure waves propagating toward the print head are generated in the ink due to acceleration working on the ink, the negative pressure applied to the nozzles changes and the meniscuses are destroyed. Therefore, the ink to be ejected cannot be maintained under a constant condition, affecting printing quality.

Further, air may be introduced into the ink tube or the connecting portion between the damper and the ink tube, for example, when an ink tank is changed. When air is delivered by the ink flow to the ink nozzles through the ink tubes and other parts, the ink passage is closed by an air bubble when such an air bubble becomes large. Therefore, the ink jet printer is provided with a purging operation that is a process to recover the state of the ink to be ejected from the ink nozzles.

However, when discharging the air, ink is also discharged. This causes not only a wasting of ink but also a decrease in the efficiency of the air purging operation.

SUMMARY OF THE INVENTION

In the light of the foregoing, it is desirable to provide an ink jet printer of an ink tube supply type that addresses the foregoing drawbacks associated with ink jet printers described above.

One aspect of the invention involves an ink jet printer that includes a print head that has at least one ink nozzle and performs printing on a recording medium by ejecting ink from the ink nozzle; an ink tank that stores ink to be supplied to the print head; an ink passage that is connected to the ink tank to supply ink from the ink tank; an air chamber that is connected to the ink passage and the print head to store air generated in the ink passage; a purge device that discharges the air stored in the air chamber from the ink nozzle; and a filter member that divides the lower portion of the air chamber into a first chamber at the ink tank side and a second chamber at the ink head side. The air generated in the ink passage is stored in the top portion of the air chamber and the filter member passes ink therethrough when the print head performs printing.

The upper portion of the air chamber has less resistance to the ink flow than that of the filter member. The air stored in the air chamber is discharged when the purge device generates an ink flow that goes above the filter member.

BRIEF DESCRIPTION OF THE DRAWINGS

The invention will be described in greater detail with reference to embodiments thereof and the accompanying drawings wherein.

DETAILED DESCRIPTION OF PREFERRED EMBODIMENTS

Figure 1:
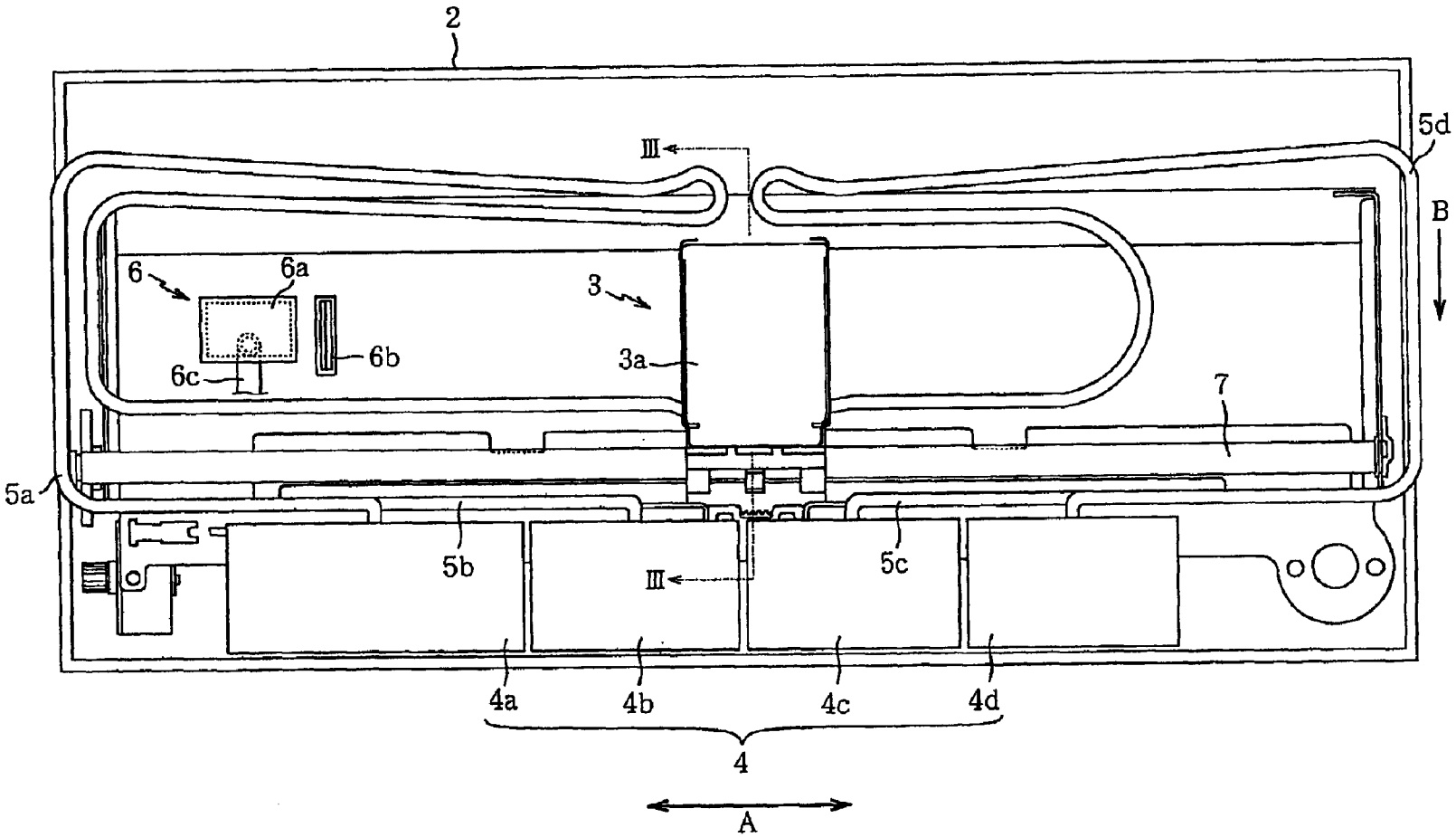
FIG. 1 is a developed side view of an ink jet printer according to one embodiment of the invention.

FIG. 1 is a side view of an ink jet printer 1 according to a first embodiment of the invention. The ink jet printer 1 includes a printer body 2 of flame-retardant plastic and substantially in the shape of a box, a print head unit 3, ink tanks 4*a*–4*d*, tubes 5*a*–5*d* interconnecting the print head unit 3 and the ink tanks 4*a*–4*d*, a purge device 6, and a guide rod 7.

Figure 2:
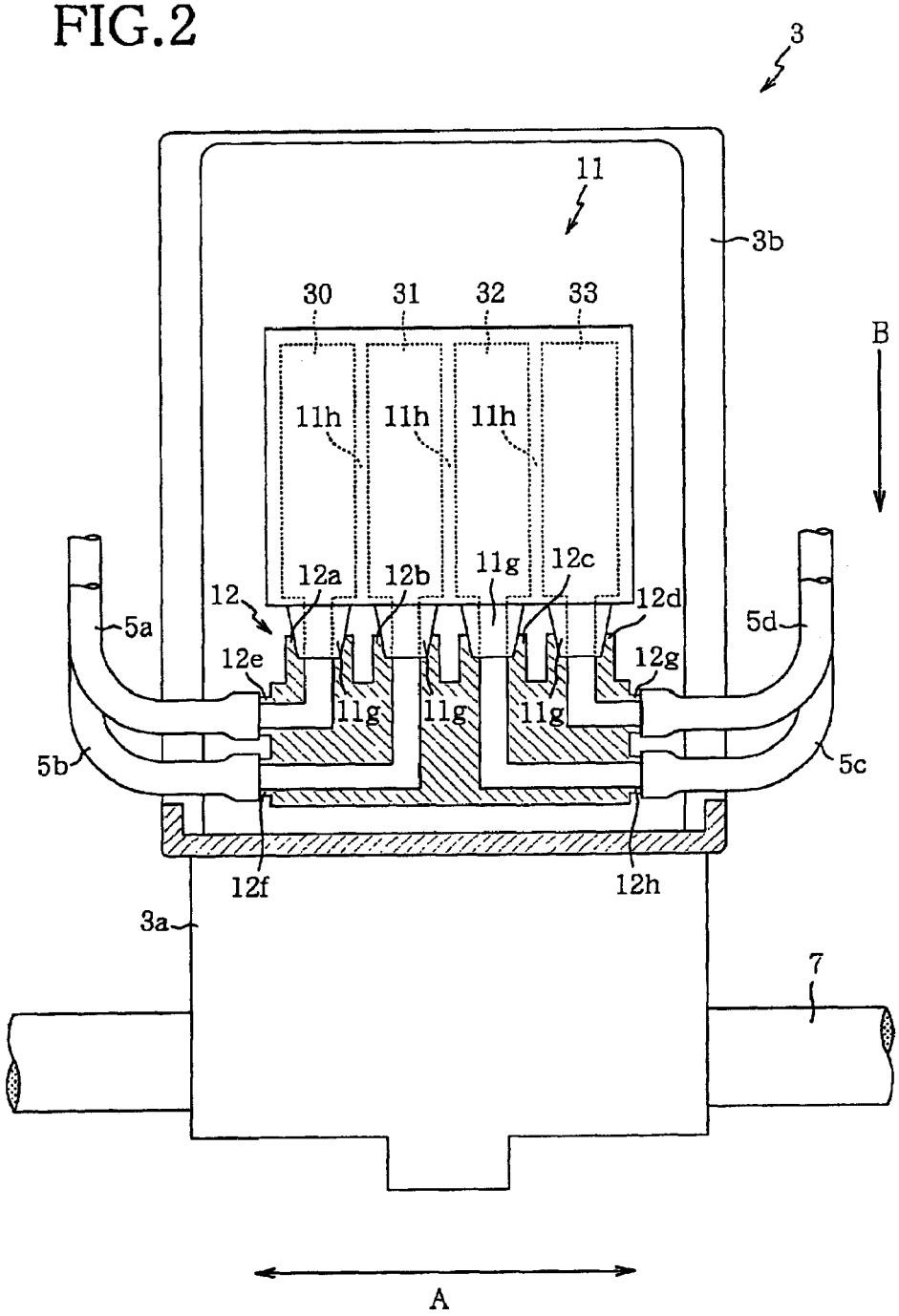
FIG. 2 is a sectional view of a print head unit of the invention.
Figure 3:
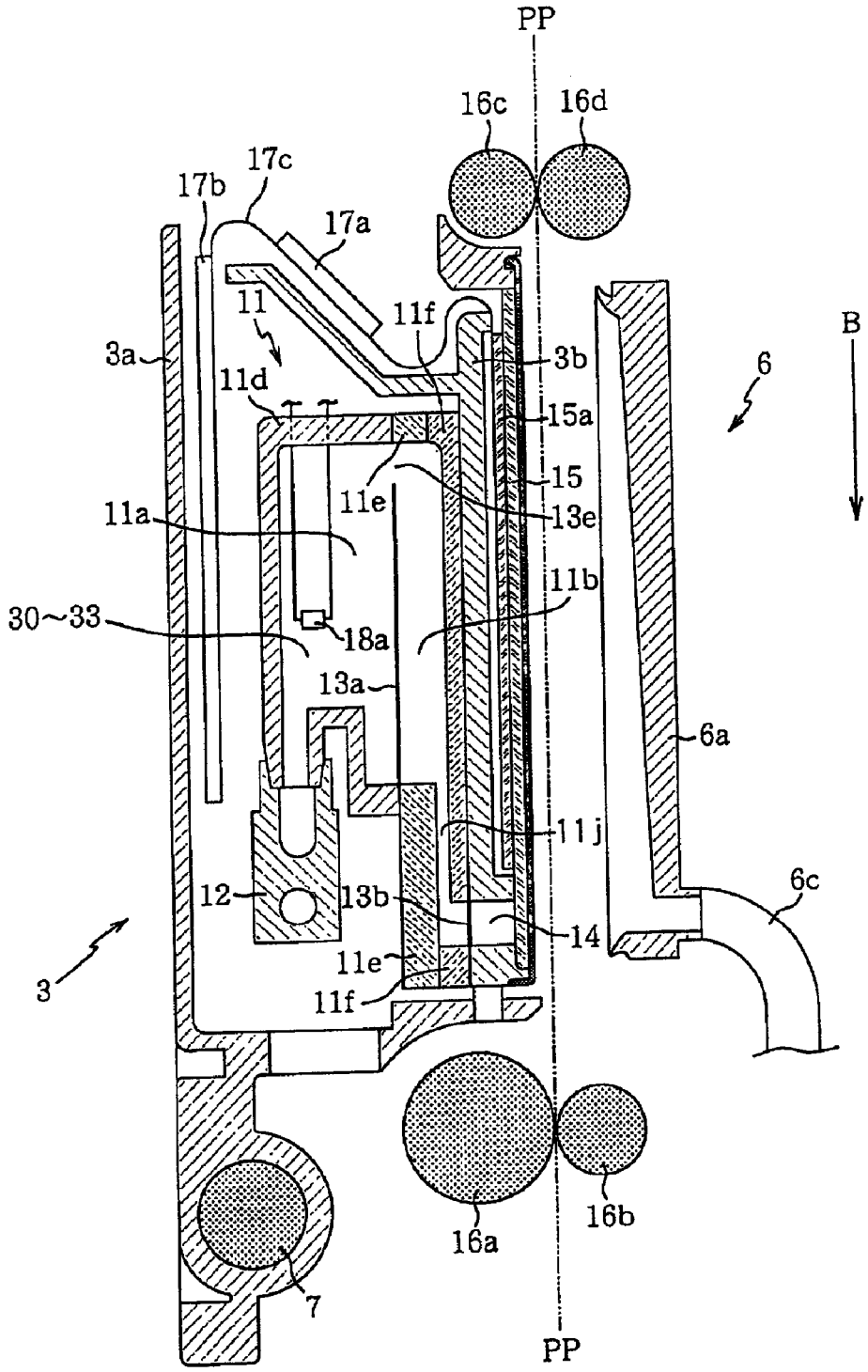
FIG. 3 is a sectional view of a print head unit including an air trap unit, a purge device and feed rollers of a first embodiment of the invention.

The print head unit 3 is equipped with a plurality of print heads 15, each of which ejects ink onto a paper sheet PP for printing (FIG. 3). The print head unit 3 is in fluid communication with the ink tanks 4*a*–4*d*, provided at a lower part of the printer body 2, via the tubes 5*a*–5*d* and a joint member 12 (FIG. 2), and receives ink from the ink tanks 4*a*–4*d*. The print head unit 3 is installed on the carriage 3*a*, which is attached to a belt (not shown). The belt is looped around a roller (not shown) attached to a motor (not shown). When the motor runs, the belt is driven, which allows the carriage 3*a* with the print head unit 3 to move for the distance the belt is driven.

The guide rod 7 is slidably inserted into the carriage 3*a* to support the carriage 3*a* so that it can move in direction A orthogonal to a sheet feed direction. The print head unit 3 on the carriage 3*a* moves reciprocally in a direction parallel to the guide rod 7, that is, in direction A of the length of the printer body 2.

The ink tank 4 is designed to store ink supplied to the print head unit 3, and is disposed below the print head unit 3. The ink tank 4 comprises a plurality of sub-ink tanks and, in this embodiment, four ink tanks 4*a*–4*d* to store black, yellow, cyan, and magenta inks in the identified order from left to right, as shown in FIG. 1. One end of each of the tubes 5*a*–5*d* is attached to the corresponding ink tank 4*a*–4*d* so as to supply the respective color ink of black, yellow, cyan and magenta to the print head unit 3. The other end of each of the tubes 5*a*–5*d* is connected to a print head 15 for the corresponding color ink. The respective color inks are ejected from the print heads 15, enabling full-color printing on a paper sheet PP.

The purge device 6, that performs the purging operation, is disposed on a left end of the printer body 2. The purging operation is a process to recover the state of the ink to be ejected from the print heads 15. The purge device 6 is provided with a suction cap 6*a* that can hermetically seal the ink nozzles of the print heads 15, a wiper 6*b* that wipes the surface of the ink nozzles, and a pump (not shown) that sucks ink from the suction cap 6*a* via a discharge tube 6*c*. The purge device 6 may be designed to discharge the ink from the print heads 15 by applying a positive pressure to the ink from the ink tank 4.

During the purging operation, the motor is driven to move the print head unit 3, equipped with the print heads 15, to the left of the ink jet printer 1 as shown in FIG. 1. The ink nozzles of the print heads 15 are hermetically sealed by the suction cap 6*a*. Then, the pump is actuated and air bubbles and solidified ink are sucked and discharged from the tube 6*c*. The wiper 6*b* wipes the surface of the print heads 15, so that the state of the ink nozzles is recovered.

A control circuit board (not shown) mounting a CPU, a ROM, a RAM and other control devices is provided inside the printer body 2. The control circuit board controls the ink jet printer 1 according to control programs related to operation of the ink jet printer 1. The purging operation by the purge device 6 is also controlled by the control circuit board.

The print head unit 3 will be described in detail with reference to FIGS. 2 and 3. As shown in FIG. 2, the carriage 3*a* is provided with a body 3*b* for accommodating an air trap unit 11 and the joint member 12. The air trap unit 11 is designed to trap air bubbles included in the ink supplied from the ink tanks 4*a*–4*d* to the print heads 15 and prevent such air bubbles from flowing into the print heads 15. The air trap unit 11 is divided by partitions 11*h* into air trap chambers 30–33 so that each chamber, containing a different color ink, is linked to a print head of the corresponding color ink. The four air trap chambers 30–33 are made into one body so that the number of parts is decreased.

The air trap chambers 30–33 are provided with intakes 11*g* at the bottom, each intake 11*g* connecting the joint member 12 and an appropriate one of the air trap chambers 30–33.

The joint member 12 is a structural component to connect tubes 5*a*–5*d*, each supplying ink from a corresponding ink tank 4*a*–4*d* to the air trap chambers 30–33, and is formed into one body by injection molding. The joint member 12 is made of thermal plastic elastomer or TPE. TPE has characteristics between rubber and plastic or characteristics of both of them, and shows elastic characteristics of rubber at normal temperatures. This elasticity absorbs displacement errors made when the air trap chambers 30–33 are connected or errors in the size of the air trap chambers 30–33. On the other hand, TPE is plasticized at high temperatures. Therefore, forming by a synthetic resin forming machine becomes easier. Olefinic PTE, butyl PTE, and silicon PTE can be used for the joint member 12. In this embodiment, olefinic PTE is preferrable when air penetrability, moldability, cost effectiveness and environmental issues are considered.

An outer profile of the joint member 12 is in a cubic shape, and the joint member 12 is provided with four connecting ports 12*a*–12*d* corresponding to the air trap chambers 30–33, respectively, and four ink ports 12*e*–12*h* corresponding to the tubes 5*a*–5*d*, respectively. The connecting ports 11*g* are connected to the connecting ports 12*a*–12*d*. The ink ports 12*e*–12*h* are of a cylindrical shape. In order to keep the joint member 12 in balance, the ink ports 12*e*, 12*f* are provided on one side of the joint member while the ink ports 12*g*, 12*h* are provided on the other side of the joint member 12. The ink ports 12*e*–12*h* are connected to the ink tubes 5*a*–5*d*, respectively.

The connecting ports 12*a*–12*d*, connected to the air trap chambers 30–33, and the ink ports 12*e*–12*h*, connected to the ink tubes 5*a*–5*d*, communicate with each other through the joint member 12, respectively, so that ink is supplied respectively to the air trap chambers 30–33 from the ink tanks 4*a*–4*d* through the ink tubes 5*a*–5*d* and the joint member 12.

Referring to FIG. 3, paper feed rollers 16*a*–16*d* are provided for the print head unit 3 for feeding a paper sheet PP onto which the print head unit 3 prints. Two paper feed rollers 16*a*, 16*b* are placed at the bottom portion of the print head unit 3 and the other two paper feed rollers 16*c*, 16*d* are placed at the top portion of the print head unit 3. The paper feed rollers 16*a*–16*d* are controlled by the signals from the control circuit board of the ink jet printer 1 to feed a paper sheet PP in the direction perpendicular to the moving direction A of the print heads 15, that is the vertical direction B. The paper feed line of a paper sheet PP is indicated by a dot line in FIG. 3.

The print head unit 3 is placed at a position facing and parallel to the paper feed line along which the paper sheet PP is carried by the paper feed rollers 16*a*–16*d*. The print head unit 3 is provided, on the paper sheet feeding side, with a plurality of print heads 15 corresponding to the air trap chambers 30–33, respectively.

The print heads 15 are provided with a plurality of ink nozzles facing the paper sheet PP and ink is delivered to ink channels from each air trap chamber 30–33 so that ink is ejected from the ink nozzles in accordance with the deformation of the actuator 15*a*.

The print heads 15 are supported by the body 3*b* and connected with the air trap chambers 30–33 through connecting passages 14. Each air trap chamber 30–33 is divided into a first chamber 11*a* and a second chamber 11*b* by a first filter 13*a* and extends vertically along the body 3*b*, as shown in FIG. 3. The first and second chambers 11*a*, 11*b* are placed vertically in the position perpendicular to the moving direction of the carriage 3*a*. Accordingly, the first chamber 11*a* is placed on the side of the ink tank 4 and the second chamber 11*b* is placed on the side of the print heads 15.

The first chamber 11*a* is separated by the first filter 13*a* and is located on the side of the ink tank 4, upstream of the ink passage. The first filter 13*a* separates the two chambers 11*a*, 11*b*, and opening 13*e* of the first filter 13*a* is left open. The ink supplied from the ink tanks 4*a*–4*d* through the tubes 5*a*–5*d* is introduced into the proper first chamber 11*a* through the joint member 12 connected to the bottom portion of the first chamber 11*a*. The ink introduced into the first chamber 11*a* is supplied to the second chamber 11*b* through the first filter 13*a* and the opening 13*e* provided at the upper position of the first filter 13*a*, as shown in FIGS. 5A–5F.

A thermistor 18*a* is provided in the first chamber 11*a*. The thermistor 18*a* is hung from the top of the first chamber 11*a* to detect the ink level in the first chamber 11*a*. The thermistor 18*a* has a pair of positive and negative electrodes and electricity is supplied thereto continuously. When the thermistor 18*a* is immersed in the ink, the temperature of the thermistor 18*a* does not rise. When the thermistor 18*a* is not covered by the ink in the first chamber 11*a*, the temperature goes up. The resistance of the thermistor 18*a* changes when the temperature changes. The thermistor 18*a* is connected to a signal line of the control circuit provided in the printer body 2. When a resistance change is detected from the signal sent to the control circuit, it is determined that air trapped in the air trap chamber 30–33 has exceeded a predetermined volume. The control circuit sends out a signal to the purge device 6. The purge device 6 conducts a purging operation to remove air trapped in the air trap chamber 30–33.

The second chamber 11*b* is separated by the first filter 13*a* and is located on the side of the print heads 15, downstream of the ink passage. The second chamber 11*b* is provided with a guide nozzle 11*j* at the bottom portion. The guide nozzle 11*j* is connected to the ink nozzle through the passage 14. The ink is supplied from the second chamber 11*b* to the corresponding print head 15. Accordingly, the length of the print head unit is reduced by the omission of connecting tubes.

The volume of the second chamber 11*b* is set to be smaller than that of the first chamber 11*a*. In this embodiment, the volume of the second chamber 11*b* is set at about half of that of the first chamber 11*a*. When air trapped in each air trap chamber 30–33 is sucked by the purging operation, ink contained in the second chamber 11*b* is discharged. In this embodiment, because the volume of the second chamber 11*b* is smaller than that of the first chamber 11*a*, the amount of discharged ink becomes smaller. Further, pressure required to suck ink, that is, to suck air from the second chamber 11*b* is reduced.

An inner wall of the second chamber 11*b* is formed by crystalline resin having high wettability to ink or the surface of the inner wall is finished to improve wettability to ink. Thus, the inner wall easily gets wet with ink. Because it is difficult for ink to stay at the inner wall, air trapped in the second chamber 11*b* is discharged easily and quickly.

The first filter 13*a*, as described above, divides the lower portion of each air trap chamber 30–33 into the first and second chambers 11*a*, 11*b* at such a position that the volume of the second chamber 11*b* is smaller than that of the first chamber 11*a* or about half of the first chamber 11*a*. The first filter 13*a* extends vertically, parallel to the body 3*b* of the print head unit 3. The face of the first filter 13*a* is placed parallel to the moving direction A of the carriage 3*a* and the longer side of the first filter 13*a* is also placed parallel to the moving direction A of the carriage 3*a* so the height, in the vertical direction B, of the filter element in each air trap chamber 30–33 is greater than the width. Because the first filter 13*a* is placed parallel to the moving direction A of the carriage 3*a*, the print head of the embodiment becomes smaller in size and length in the orthogonal direction to the moving direction of the carriage 3*a* than a print head that has a first filter placed perpendicular to the moving direction of the carriage.

The first filter 13*a* is a meshed net made of stainless steel having openings of the diameter at 16 $\mu$m in order to prevent air generated in the ink passage from passing through the first filter 13*a*.

The vertical dimension (in direction B) of the first filter 13*a* is shorter than the vertical inside dimension of each air trap chamber 30–33 to form the opening 13*e*. The opening 13*e* allows ink to communicate between the first and second chambers 11*a*, 11*b* with less resistance. The first filter 13*a* continues to the opposed inner walls extending in the width direction (direction A) of each air trap chamber 30–33 to prevent air introduced into the first chamber 11*a* from entering into the second chamber 11*b*. Each air trap chamber 30–33 and the first filter 13*a* are placed in the vertical direction so that air introduced into the air trap chamber 30–33 goes up along the first chamber 11*a* and is trapped at the top portion of the first chamber 11*a* because the first filter 13*a* does not allow air to go through its openings. Because the first filter 13*a* is made of stainless steel which has wettability to ink, it is difficult for air to stay at the first filter 13*a* but it is easy for air to move up to the first chamber 11*a*.

A passage filter 13*b* is provided at the passage 14 which connects the guide nozzle 11*j* of each air trap chamber 30–33 and the corresponding print head 15 in order to catch dirt contained in the ink before supply to the print heads 15. The passage filter 13*b* is made to cover the passage 14 and is thermally welded to the passage 14. The passage filter 13*b* has openings small enough to catch dirt but large enough to pass ink and air during purging.

A driver circuit board 17*a* is provided at the top portion of the body 3*a* of the print head unit 3. The driver circuit board 17*a* is mounted on the flexible printed circuit board 17*c*. The driver circuit board 17*a* is controlled by the control circuit mounted on the printer body 2. The driver circuit board 17*a* changes serial signals sent by the control circuit into parallel signals corresponding to the actuator 15*a* in order to control the actuator 15*a*. The flexible printed circuit board 17*c* is provided with two thin non-conductive flexible films and a conductive layer providing wiring patterns placed between the two films. One end portion of the flexible printed circuit board 17*c* is provided with terminals connected to the actuator 15*a* and the earth. The other end portion of the flexible printed circuit board 17*c* is provided with terminals connected to an interface board 17*b* described below.

An interface board 17*b* is placed adjacent to the carriage 3*a* in the body 3*b* of the print head unit 3. The interface board 17*b* is connected to a terminal portion of the flexible print board 17*c* and is provided with a connector which connects signal wires from the control circuit with the driver circuit board 17*a* and a noise reduction circuit.

Figure 4:
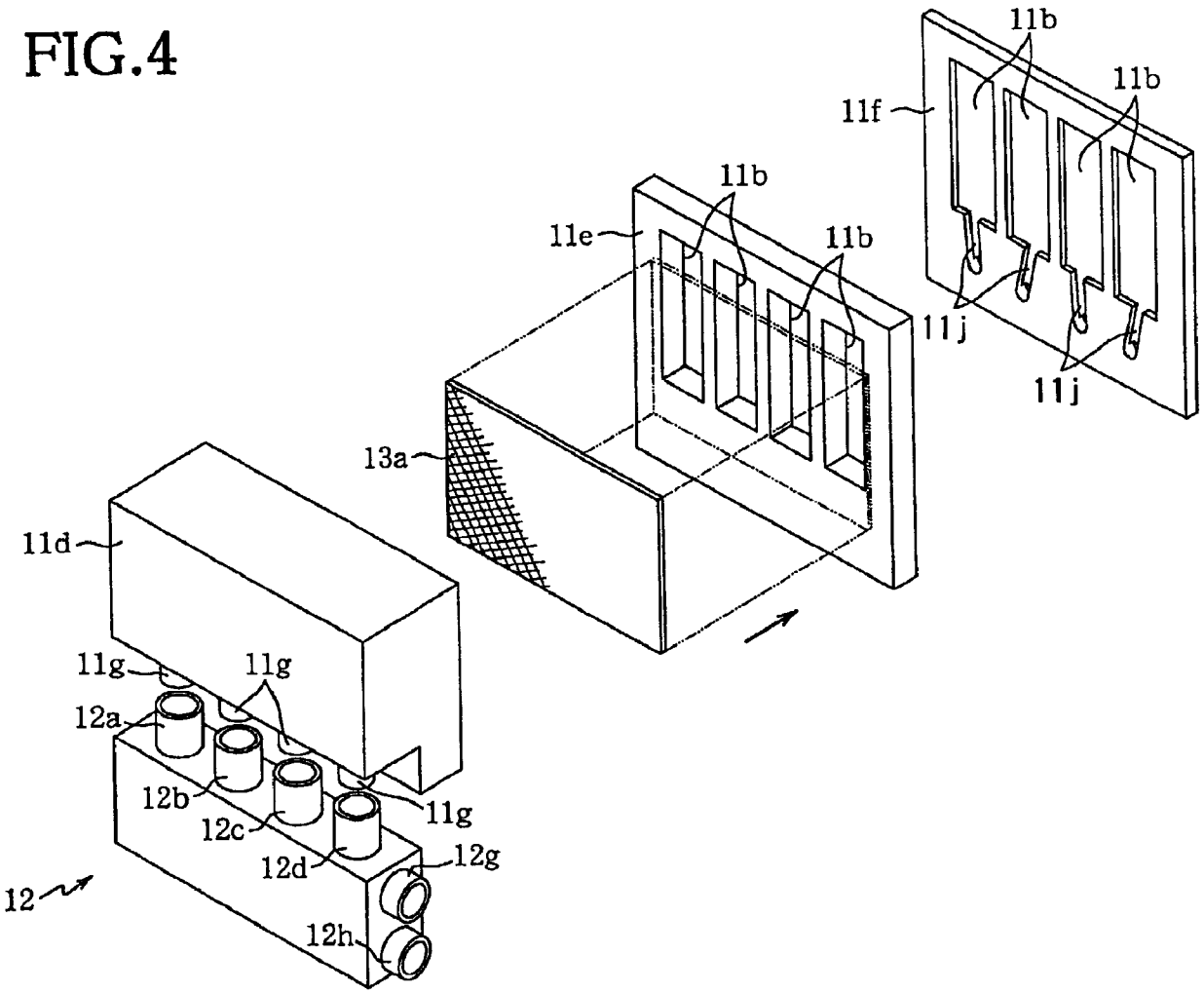
FIG. 4 is a disassembled perspective view of the air trap unit of the first embodiment of the invention.

Referring to FIG. 4, the air trap unit 11 and the joint member 12 are further described. The air trap unit 11 comprises three parts 11*d*–11*f*. Each part 11*d*–11*f* is formed to have four air trap chambers 30–33, corresponding to the four ink tubes 5*a*–5*d*. Each part 11*d*–11*f* is made of a thermoplastic resin considering physical properties, such as moldability, resistance to solvents, resistance to contamination, chip resistance, and wettability to ink.

The part 11*d* is provided with four first chambers 11*a* divided by the partitions 11*h* as shown in FIG. 2. Each chamber 11*a* is box shaped and has an opening through which the first filter 13*a* is attached. The part 11*d* is provided at the bottom with intakes, or connecting portions, 11*g* to be connected to the joint member 12. The connecting portions 11*g* are cylindrical projections corresponding to the ink tubes 5*a*–5*d*. The joint member 12 is provided with connecting ports 12*a*–12*d* that communicate with the ink tubes 5*a*–5*d*, respectively. The connecting ports 12*a*–12*d* are connected to the connecting portions 11*g* so that ink is introduced from the ink tank 4 to the air trap chambers 30–33 through the ink tubes 5*a*–5*d*.

The first filter 13*a* is fixed by thermal fusion to the part 11*e* to operate as the first filter 13*a* for each air trap chamber 30–33. The face of the first filter 13*a* is placed parallel to the moving direction of the carriage 3*a* and the longer side of the first filter 13*a* is also parallel to the moving direction of the carriage 3*a*. In this embodiment, one first filter 13*a* provides four filter portions for the air trap chambers 30–33 so that the first filter 13*a* for the four air trap chambers 30–33 are made at a time by thermal fusion of the first filter 13*a* to the part 11*e*.

The length of the first filter 13*a* corresponds to the total width of series of the four air trap chambers 30–33 in addition to the fusion areas on both sides. The height of the first filter 13*a* corresponds to a height to cover a predetermined lower area of the air trap chambers 30–33 in addition to the fusion area. The first filter 13*a* having such a size is fixed to the part 11*e* by thermal fusion so as to provide openings at the upper portion of the part 11*e* constituting the second chambers. Thus, the first filter 13*a* is placed in such a position as to divide the air trap chambers 30–33 into the first chambers 11*a* and the second chambers 11*b*.

The part 11*e* has four openings to define the four second chambers 11*b*. One side of the part 11*e* is fixed to the first filter 13*a* and the other side of the part 11*e* is fixed to the part 11*f* by ultrasonic fusion in order to form the four second chambers 11*b*. The part 11*f* has four recessed portions corresponding to the four openings of the part 11*e*. The part 11*f* is provided with conduits formed below the recessed portions to form the guide nozzles 11*j*. End terminals of the conduits go through the part 11*f* to the rear side so that the guide nozzles 11*j* are connected to the passages 14. The second chamber 11*b* is directly connected to the corresponding print head 15. Accordingly, the length of the print head 15 which is perpendicular to the moving direction of the carriage 3*a* is reduced by the omission of connecting tubes.

To make the air trap unit 11 from the parts 11*d*–11*f*, first the first filter 13*a* is fixed to the part lie by thermal fusion. The part 11*f* is fixed to the part lie by ultrasonic fusion. The part 11*d* is fixed to the part 11*e* from the side of the first filter 13*a* by ultrasonic fusion. The fabrication of the air trap unit 11 becomes simpler than making each air trap chamber one by one. It is also easy to manage the process because the number of parts is less. Further it is easy to fabricate because each part becomes bigger.

Figures 5A, 5B, 5C, 5D, 5E, 5F:
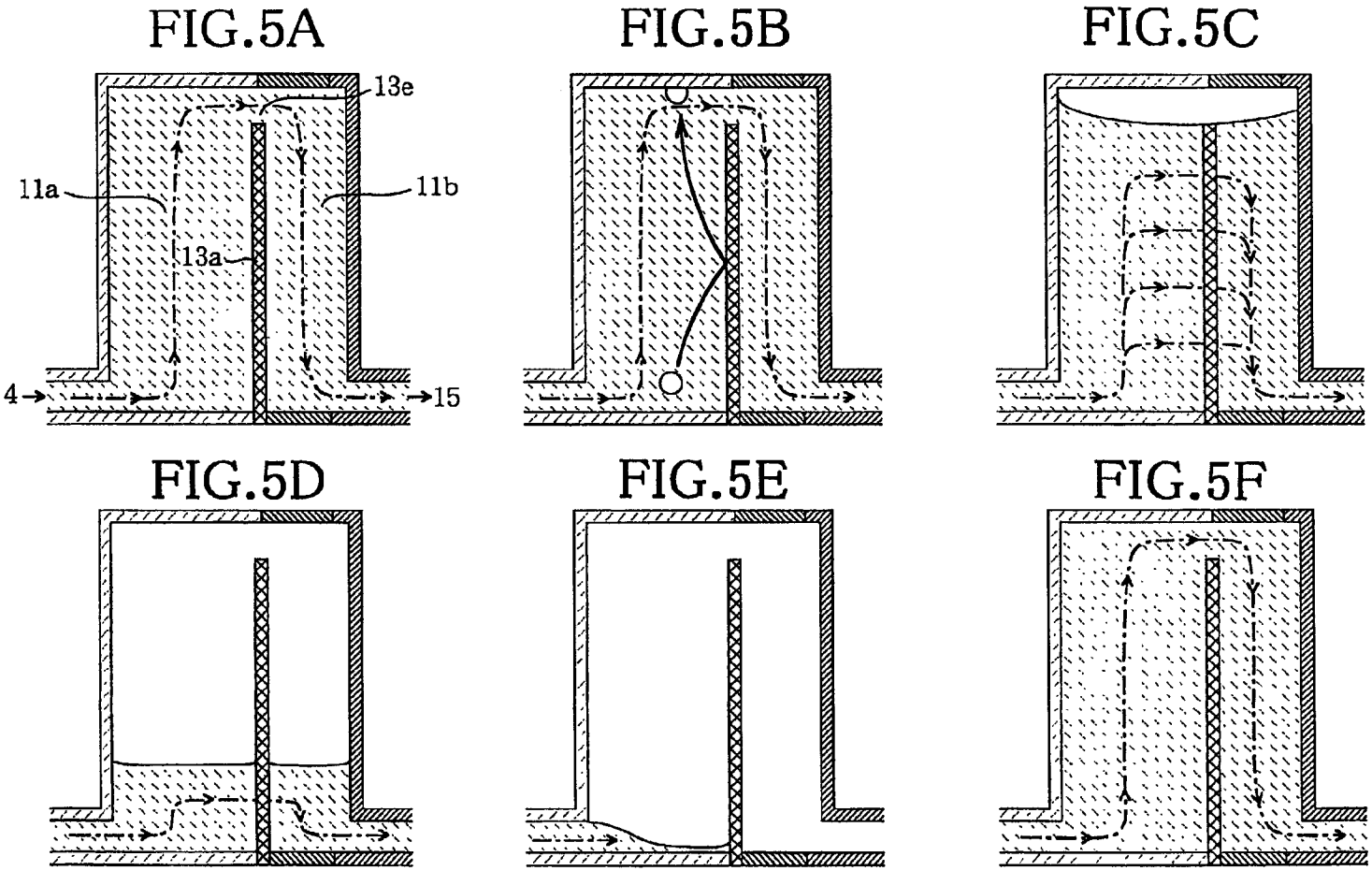
FIGS. 5A–5F are perspective views showing the operation of the air trap unit of the first embodiment of the invention.

Referring to FIGS. 5A–5F, ink flow patterns and the condition of the trapped air will be described. FIG. 5A shows an initial condition of an air trap chamber 30–33 of the air trap unit 11 immediately after the purging operation. In FIG. 5A, as ink is consumed at the print head 15, ink supplied from the ink tank 4 to the first chamber 11*a* goes into the second chamber 11*b* over the first filter 13*a*, i.e., through the opening 13*e* where the first filter 13*a* is not provided. The opening 13*e* has less resistance to the ink flow than the first filter 13*a* thereby allowing such an ink flow.

In FIG. 5B, when a small amount of air enters the first chamber 11*a* of the air trap chamber 30–33, air is unlikely to stick to the first filter 13*a* because of the good ink wettability of the first filter 13*a*. In addition, because the air trap chamber 30–33 is placed in the vertical direction, air rises by its own buoyancy along the ink current flow. Further, because the openings of the first filter 13*a* are smaller in size than the air bubbles, the air bubbles do not pass through the openings of the filter 13*a*, but rise along the ink current flow.

The inner wall of the first chamber 11*a* is formed with a material having less ink wettability as compared to the inner wall of the second chamber 11*b*, so that air stays in the first chamber 11*a* rather than in the second chamber 11*b*. When the volume of air trapped in the chambers 11*a*, 11*b* is relatively small, the opening 13*e* between the first chamber 11*a* and the second chamber 11*b* is not blocked by the trapped air. Ink supplied into the first chamber 11*a* flows into the second chamber 11*b* through the opening 13*e*. The speed of the ink flow directed to the print head 15 or the suction force of the ink during printing is not fast enough to push the trapped air out from the chambers 11*a*, 11*b*.

In FIG. 5C the trapped air becomes great enough to block the opening 13*e* between the first and second chambers 11*a*, 11*b*. Ink supplied to the first chamber 11*a* is blocked from going into the second chamber 11*b* through the opening 13*e*. Once the opening 13*e* is closed by the trapped air, ink goes through the first filter 13*a* as shown in FIG. 5C.

In FIG. 5D, the volume of the trapped air becomes larger and pushes the level of the ink surface in the chambers 11*a*, 11*b* down. The area of the first filter 13*a* and its openings are appropriately set to pass a sufficient ink supply even when the ink level falls to a predetermined level.

In FIG. 5E, the volume of the trapped air becomes large enough to fill the second chamber 11*b*. In this state, no ink is supplied to the print head 15.

In FIG. 5F, the purging operation is conducted by the purge device 6 so that the trapped air is discharged. During the purging operation, because a strong suction force is applied to the second chamber 11*b*, a resistance to the ink flow going through the first filter 13*a* becomes very large. Thus a strong ink flow going through the opening 13*e* between the first and second chambers 11*a*, 11*b* is generated to discharge the trapped air in the air trap chamber 30–33 to the outside. The first and second chambers 11*a*, 11*b* are refilled with ink and return to the initial condition shown in FIG. 5A.

In this embodiment, the thermistor 18*a* is provided to cause the purging operation when the level of ink in the first chamber 11*a* reaches a predetermined level. As described, the ink has a viscosity of 1–10 cps and a surface tension at 30–50 mN/m. The openings of the first filter 13*a* are about 16 $\mu$m.

As described above, because the first filter 13*a* functions as a dam in the air trap chambers 30–33, air generated in the ink passage, such as the ink tube 5*a*–5*d* and the joint member 12, is trapped in the air trap chamber 30–33. The print head 15 can operate for a longer time and the number of purging operations is reduced. The purging operation is conducted when the thermistor 18*a* indicates the need for the purging operation. Further the length of the first filter 13*a* is reduced because the face of the first filter 13*a* is placed parallel to the moving direction A of the carriage 3*a* and the longer side of the first filter 13*a* is also placed in the moving direction A of the carriage 3*a* so the filter height is in the vertical direction B for each air trap chamber 30–33.

In the above embodiment, the size of the openings of the first filter 13*a* is about 16 $\mu$m, however, the first filter 13*a* is not for catching dirt in the ink but is to act as a dam to separate the air trap unit 11. Therefore, the size of openings can be set under about 100 $\mu$m.

The first filter 13*a* can be made of a resin having good wettability instead of stainless steel. Resin is easier to machine and less expensive than stainless steel.

The tubes 5*a*–5*d* are made of a resin having flexibility. However, in order to reduce the permeability to air, the tubes 5*a*–5*d* can be covered by a metal film with low permeability to air.

Figure 6:
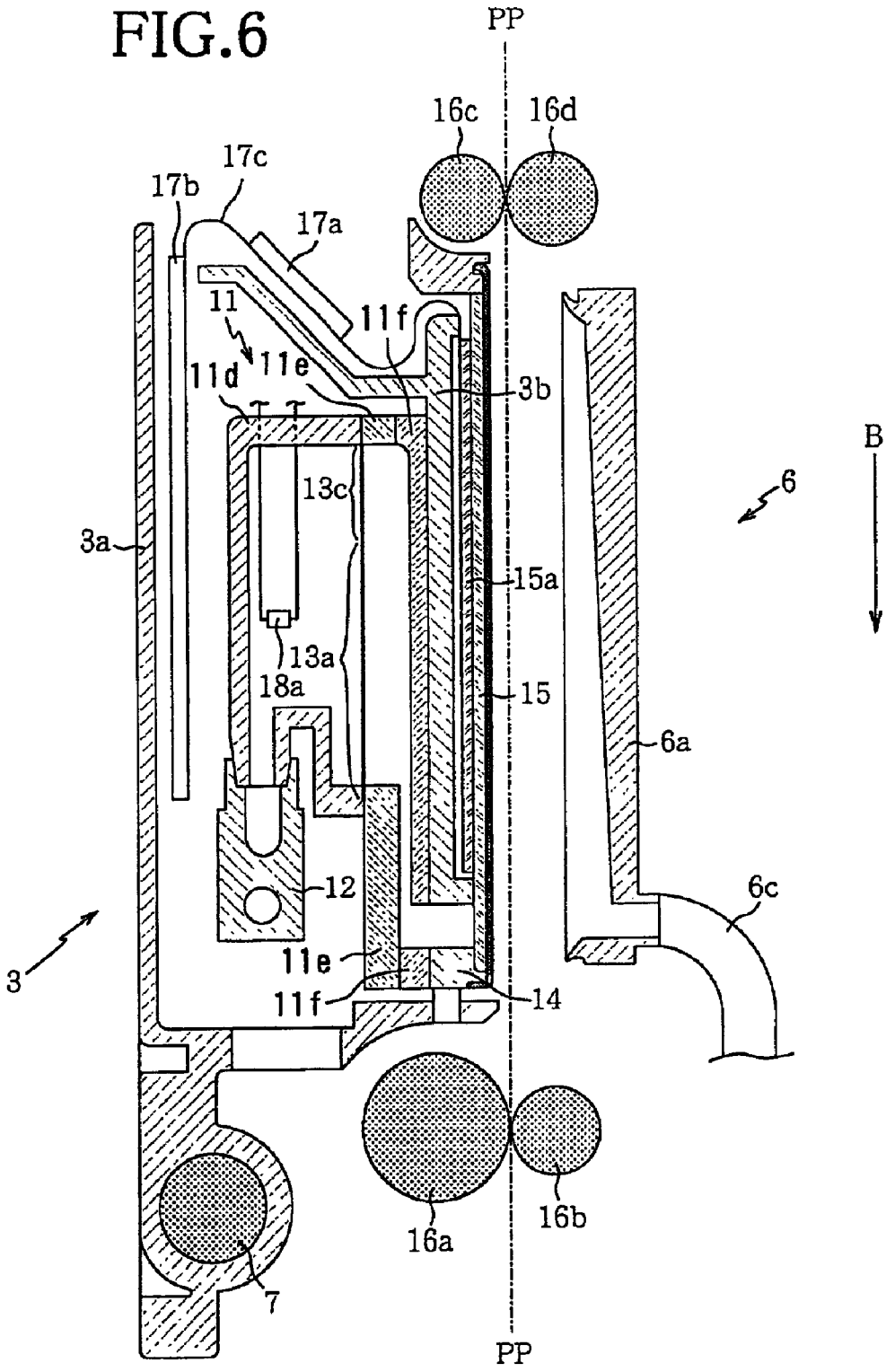
FIG. 6 is a sectional view of a print head unit of a second embodiment of the invention.

Referring to FIG. 6, a second embodiment of the invention will be described. However, the parts identical to the counterparts of the first embodiment will be assigned the same reference numerals and explanations will be omitted. In this embodiment, a second filter 13*c* is provided on the first filter 13*a*.

The second filter 13*c* has the same width as that of the first filter 13*a*. The height of the second filter 13*c* is the length from the top of the first filter 13*a* to the top or ceiling of each air trap chamber 30–33. The second filter 13*c* extends from the top of the first filter 13*a* and the other end of the second filter 13*c* is held between the part 11*d* and part 11*e*. The second filter 13*c* extends vertically from the first filter 13*a* and contacts the ceiling of each air trap chamber 30–33. In other words, the first filter 13*a* and the second filter 13*c* are placed in the same line.

Ink comes into each air trap chamber 30–33 and passes through the first filter 13*a* or the second filter 13*c*. The first and second filters 13*a*, 13*c* catch dirt in the ink. With this arrangement, the passage filter 13*b* can be omitted. The openings of the mesh of the second filter 13*c* are larger in diameter than the first filter 13*a*, and the second filter 13*c* provides less resistance to the ink flow than that of the first filter 13*a*.

A third embodiment of the invention will be described with reference to FIG. 7. The parts identical to the counterparts of the first embodiment will be assigned the same reference numerals and explanations will be omitted. In this embodiment, an optical sensor 18*b* replaces the thermistor 18*a* used to detect the level of ink in each air trap chamber 30–33 in the first embodiment.

Figure 7:
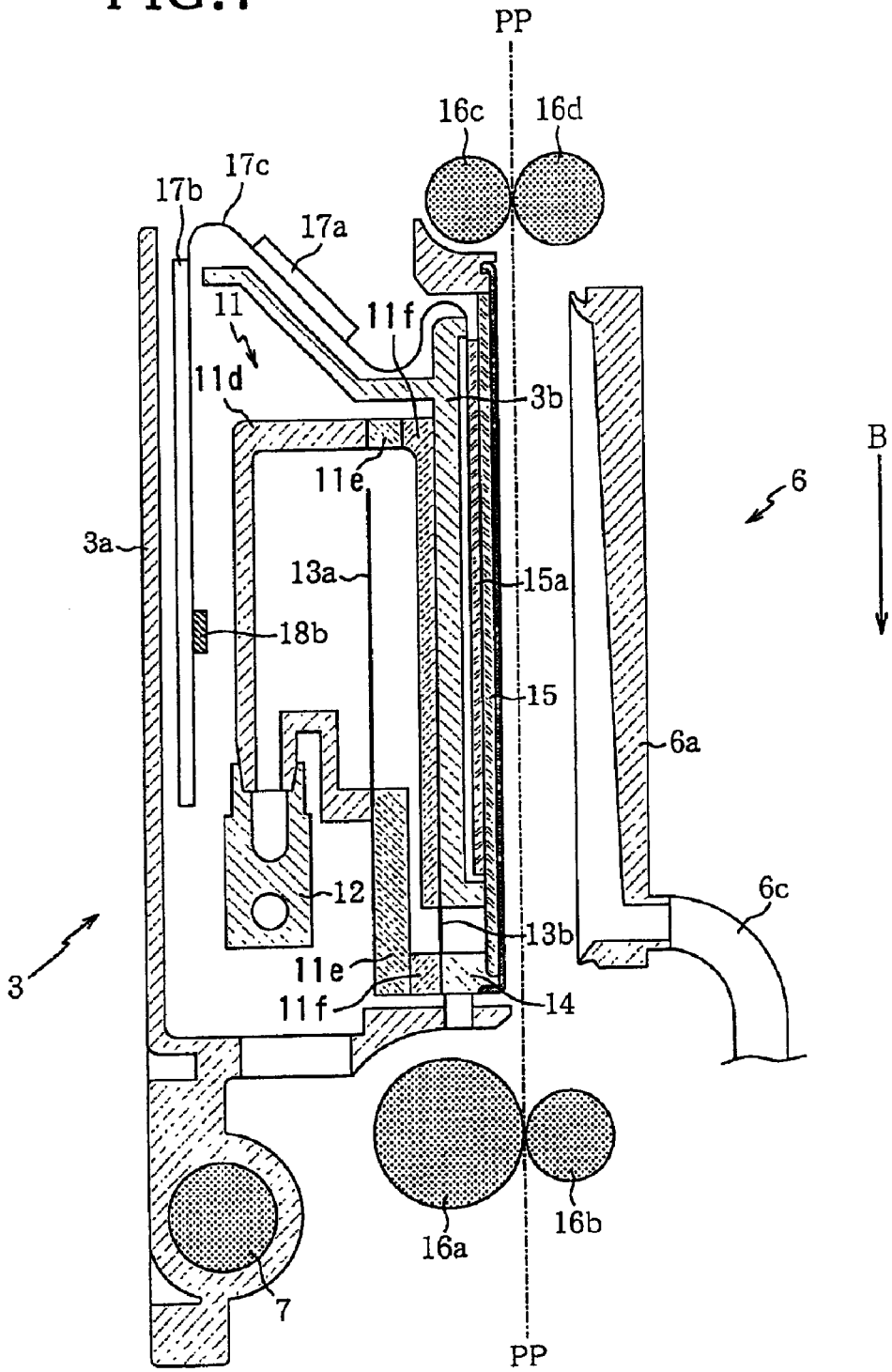
FIG. 7 is a sectional view of a print head unit of a third embodiment of the invention.

Referring to FIG. 7, the optical sensor 18*b* is placed on the rear side of the first chamber 11*a* of the air trap unit 11 in the body 3*b* of the print head unit 3. The optical sensor 18*b* comprises a light source and a detector to detect a reflected light emitted from the light source. The body 11*d* of the first chamber 11*a* of the air trap unit 11 is made of a transparent material so that the light emitted from the light source of the optical sensor 18*b* passes through. Because the amount of the light reflected is different when the level of ink is above the optical sensor 18*b* than when the level is lower than the optical sensor 18*b*, the sensor 18*b* detects the level of the ink surface in the air trap unit 11.

Because the optical sensor is placed outside the ink, the optical sensor has a longer life. When each air trap chamber 30–33 is provided with an optical sensor, the purging operation is conducted based on the sensor signal for each air trap chamber 30–33. When the ink jet printer prints in single color, an optical sensor can be arranged such that a detector is placed facing a light source.

A fourth embodiment of the invention will be described with reference to FIGS. 8 and 9. The parts identical to the counterparts of the first embodiment will be assigned the same reference numerals and explanations will be omitted.

Figure 8:
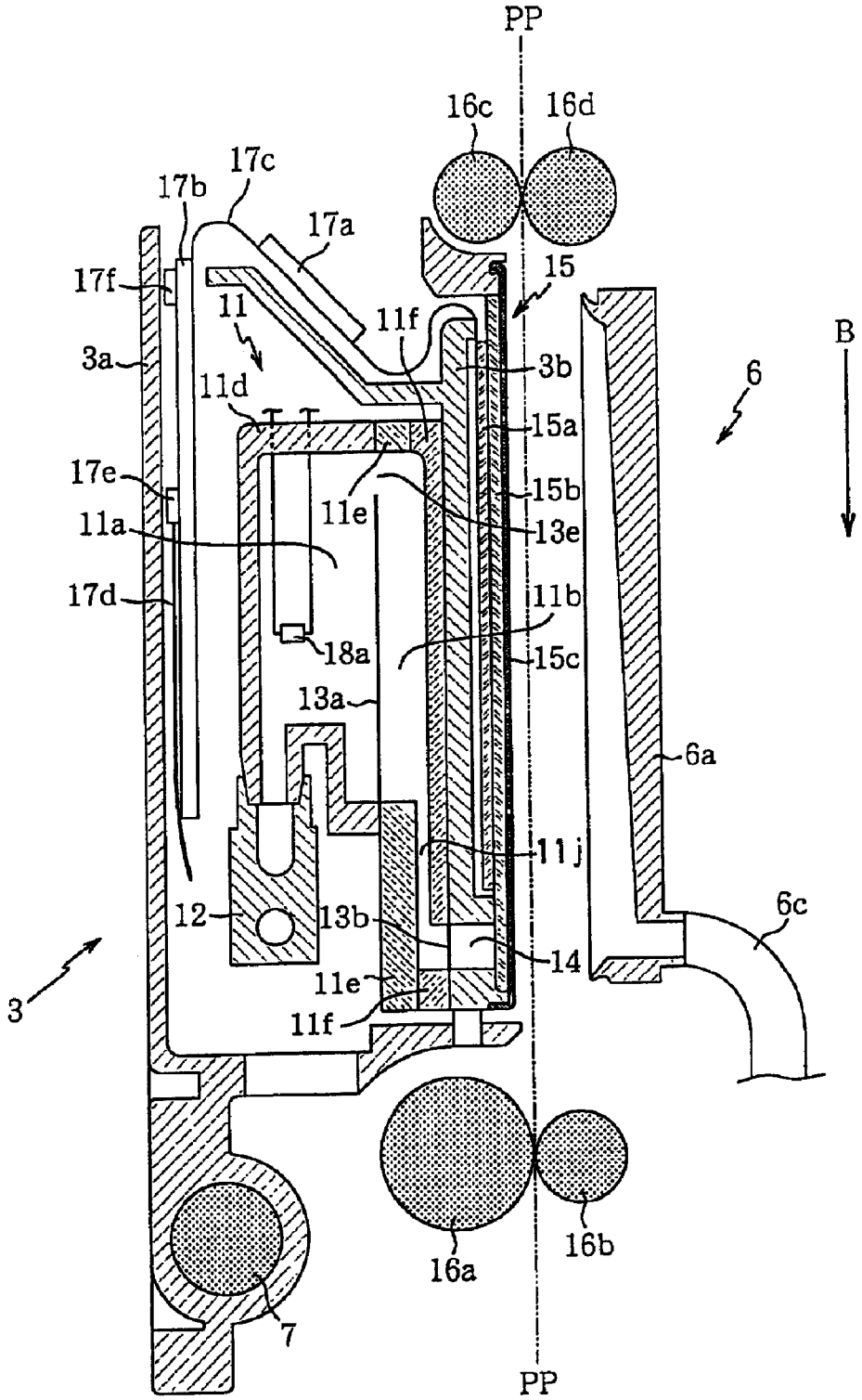
FIG. 8 is a sectional view of a print head unit of a fourth embodiment of the invention.

Referring to FIG. 8, the driver circuit board 17*a* and the interface board 17*b* are mounted on the flexible printed circuit board 17*c*. The interface board 17*b* is provided with a connector 17*e* and a noise reduction circuit 17*f*. The connector 17*e* is connected to a second flexible printed circuit board 17*d*. The second flexible printed circuit board 17*d* is made of thin films, similarly to the first flexible printed circuit board 17*d*. The second flexible printed circuit board 17*d* in the printer body 2 delivers various signals, such as serial image data, a clock signal, a latch signal, and a strobe signal sent from the control circuit board (not shown), mounted with a CPU, ROM, RAM and other elements, to the interface board 17*b*.

Figure 9:
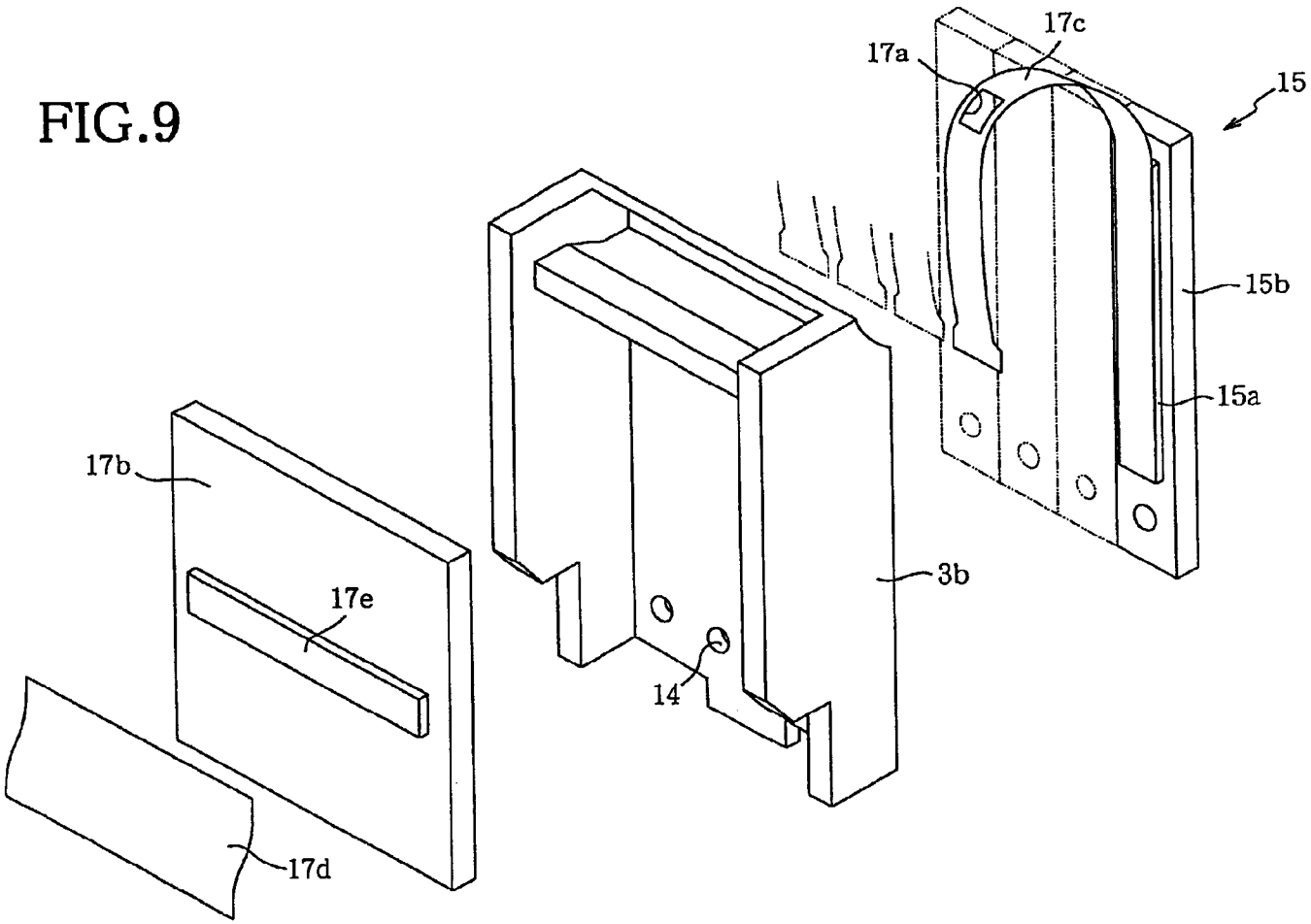
FIG. 9 is a disassembled perspective view of a print head including flexible printed circuits of the fourth embodiment of the invention.

Referring to FIG. 9, which is simplified by omitting the walls between air trap chambers 30–33, as well as other features of the air trap chambers 30–33 shown in FIG. 8, a body 3*b* of the print unit 3 is formed into a box shape and the air trap unit 11 and the joint member 12 are incorporated into the body 3*b*. The print heads 15 are fixed to the body 3*b* facing toward the print paper. The interface board 17*b* is fixed to the body 3*b* so as to cover the air trap unit 11. In other words, the interface board 17*b* is placed on one side of the body 3*b* and the print heads 15 are placed on the other side of the body 3*b*, parallel to the interface board 17*b* in order to sandwich the air trap unit 11 in between. The first flexible printed circuit board 17*c* is connected to the actuator 15*a* on the side of the print heads 15. The first flexible printed circuit board 17*c* goes over the body 3*b* and is connected to the interface board 17*b*. The body 3*b* is provided with the print heads 15, the air trap unit 11, the interface board 17*b*, and other parts, and is mounted onto the carriage 3*a*.

In this embodiment, the interface board 17*b* and the body 3*b* of the print head unit 3 are formed as one unit to cover the air trap unit 11. Accordingly, the print head unit 3 becomes smaller in size and thinner in depth.

In this embodiment, although the driver circuit 17*a* is mounted on the first flexible printed circuit board 17*c*, the driver circuit 17*a* can be placed on the interface board 17*b* and connected to the first flexible printed circuit board 17*c*.

A fifth embodiment of the invention will be described with reference to FIGS. 10 and 11. The parts identical to the counterparts of the first embodiment will be assigned the same reference numerals and explanations will be omitted.

Figure 10:
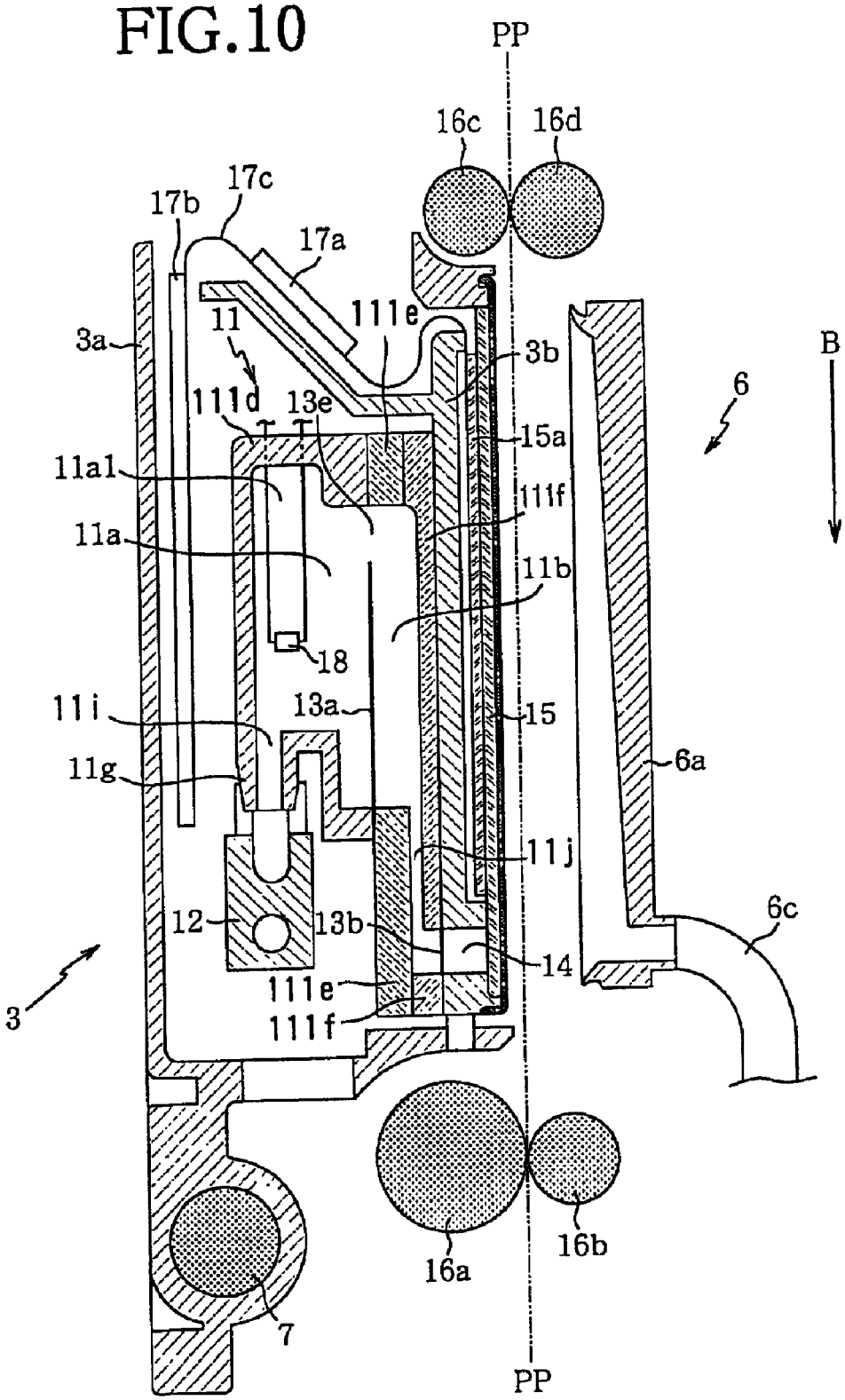
FIG. 10 is a sectional view of a print head unit of a fifth embodiment of the invention.

Referring to FIG. 10, at the upper portion of the first chamber 11*a*, an air chamber 11*a*1 is provided to trap and hold a certain amount of air at all times. The air chamber 11*a*1 is located at a higher position, or is recessed, than the remainder of the ceiling over the first and second chambers 11*a*, 11*b* such that air bubbles rise into the air chamber 11*a*1 in the first chamber 11*a*. The air chamber 11*a*1 is located at the higher position than that of the ink flow along the ceiling of the chambers 11*a*, 11*b* and above the first filter 13*a* during the purging operation. The air trapped in the air chamber 11*a*1 remains even during the purging operation by the purge device 6. The air chamber 11*a*1 is also located at a position extending from an ink inlet 11*i*. Most of pressure waves generated in the ink passage propagate along the ink flow formed in the ink passage. The pressure waves go into the air trapped in the air chamber 11*a*1 and the trapped air absorbs the pressure waves, thereby preventing the pressure waves from reaching the print head 15. In order to absorb the pressure waves generated in the ink passage, the volume of the air chamber 11*a* is less than 0.3 cc. In this embodiment, the volume of the first chamber 11*a* is set at between 0.2–0.4 cc, the volume of the second chamber 11*b* is set at between 0.03–0.1 cc and the volume of the air chamber 11*a*1 is set at between 0.05–0.1 cc.

Figure 11A:
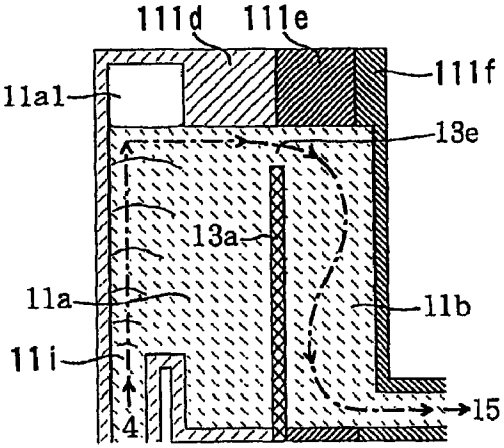
FIGS. 11A–11F are perspective views showing the operation of an air trap unit of the fifth embodiment of the invention.

Referring to FIGS. 11A–11F, the pressure wave propagation pattern, the ink flow pattern, and the condition of trapped air will be described. FIG. 11A shows an initial state of the air trap unit 11 immediately after the purging operation. Even though the first chamber 11*a* is filled with ink, air is trapped and held in the air chamber 11*a*1.

As the ink is consumed at the print heads 15, the ink supplied from the ink tank 4 to the first chamber 11*a* goes into the second chamber 11*b* over the first filter 13*a* or through the opening 13*e* where the first filter 13*a* is not provided. The opening 13*e* that has less resistance to the ink flow than the first filter 13*a* thereby allowing such ink flow.

The pressure waves generated in the ink passage due to speed changes of the carriage 3*a* propagate from the ink inlet 11*i* to the first chamber 11*a* and upward in the first chamber 11*a*. The air chamber 11*a*1 is placed in the propagation direction of the pressure waves, so that the pressure waves go into the air trapped in the air chamber 11*a*1.

Figure 11B:
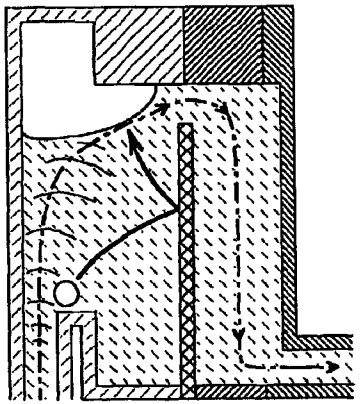

In FIG. 11B, when a small amount of air enters the first chamber 11*a* of each air trap chamber 30–33, air is unlikely to stick to the first filter 13*a* because of good ink wettability of the first filter 13*a* and the openings in the first filter 13*a* are smaller in size than the air bubbles. Because each air trap chamber 30–33 extends vertically, air rises by its buoyancy along the ink flow and merges into the air trapped in the air chamber 11*a*1.

The inner wall of the first chamber 11*a* is formed with a material having less ink wettability as compared with the inner wall of the second chamber 11*b*, so that air stays in the first chamber 11*a* rather than in the second chamber 11*b*. When the volume of air trapped in the chambers 11*a*, 11*b* is relatively small, the opening 13*e* between the first chamber 11*a* and the second chamber 11*b* is not blocked by the trapped air. The ink supplied into the first chamber 11*a* flows into the second chamber 11*b* through the opening 13*e*. The pressure waves generated in the ink passage propagate in the ink and strike the merged air in the air chamber 11*a*1 and the chambers 11*a*, 11*b*. The speed of the ink flow directed to the print head 15 or the suction force of the ink is not fast enough to push the trapped air out from the chambers 11*a*, 11*b*, so that the trapped air in the chambers 11*a*, 11*b* absorb the pressure waves efficiently.

Figure 11C:
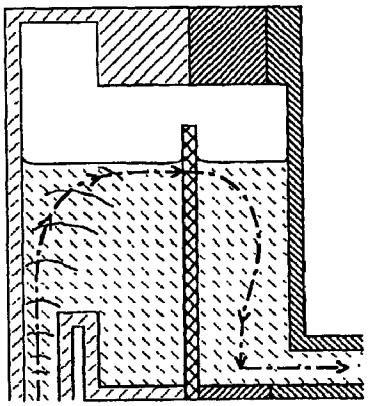

In FIG. 11C, the trapped air becomes large enough to block the opening 13*e* between the first and second chambers 11*a*, 11*b*. The ink supplied to the first chamber 11*a* is blocked and cannot go into the second chamber 11*b* through the opening 13*e*. Once the opening 13*e* is blocked by the trapped air, ink starts passing through the first filter 13*a*, as shown in FIG. 11C.

Figure 11D:
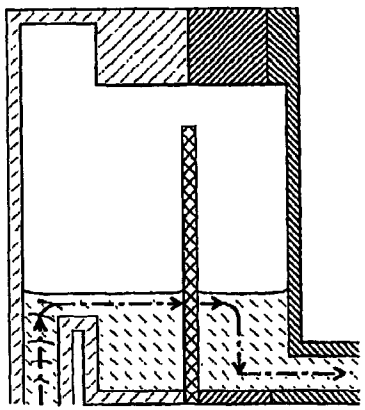

In FIG. 11D, the volume of the trapped air becomes great enough to push down the ink level in the chambers 11*a*, 11*b*. The area of the first filter 13*a* and its openings are appropriately set to ensure a sufficient ink supply even when the ink level falls to a predetermined level.

Figure 11E:
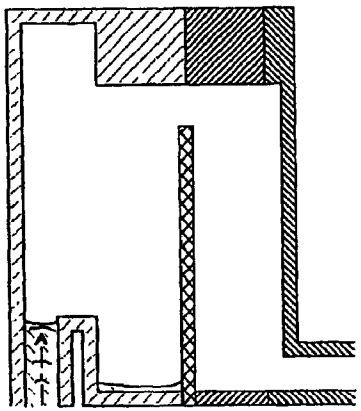

In FIG. 11E, the volume of the trapped air becomes large enough to fill out the second chamber 11*b*. In this state, no ink is supplied to the print head 15.

Figure 11F:
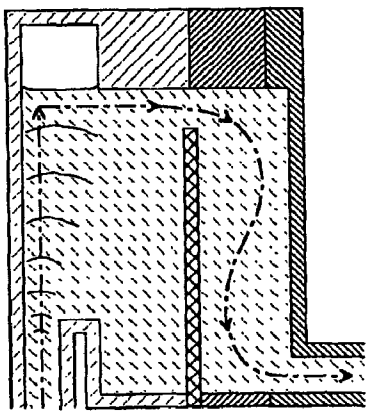

In FIG. 11F, the purging operation is conducted by the purge device 6 so that the trapped air is discharged. During the purging operation, because a strong suction force is applied to the second chamber 11*b*, resistance to the ink flow going through the first filter 13*a* becomes very high. Thus, a strong ink flow going through the opening 13*e* between the first and second chambers 11*a*, 11*b* is generated to discharge the trapped air in the air trap chambers 30–33 to the outside. The first and second chambers 11*a*, 11*b* are refilled with ink and return to the initial state shown in FIG. 11A. The air stays in the air chamber 11*a*1 during the purging operation because the air chamber 11*a*1 is located above the ink flow generated by the purging operation.

Thus, the pressure waves generated in the ink passage are absorbed by the air trapped in the air chamber 11*a*1 and prevented from reaching the print head 15. As a result, the meniscus formed at each nozzle is maintained properly.

A sixth embodiment of the invention will be described with reference to FIG. 12. The parts identical to the counterparts of the first embodiment will be assigned the same reference numerals and explanations will be omitted.

Figure 12:
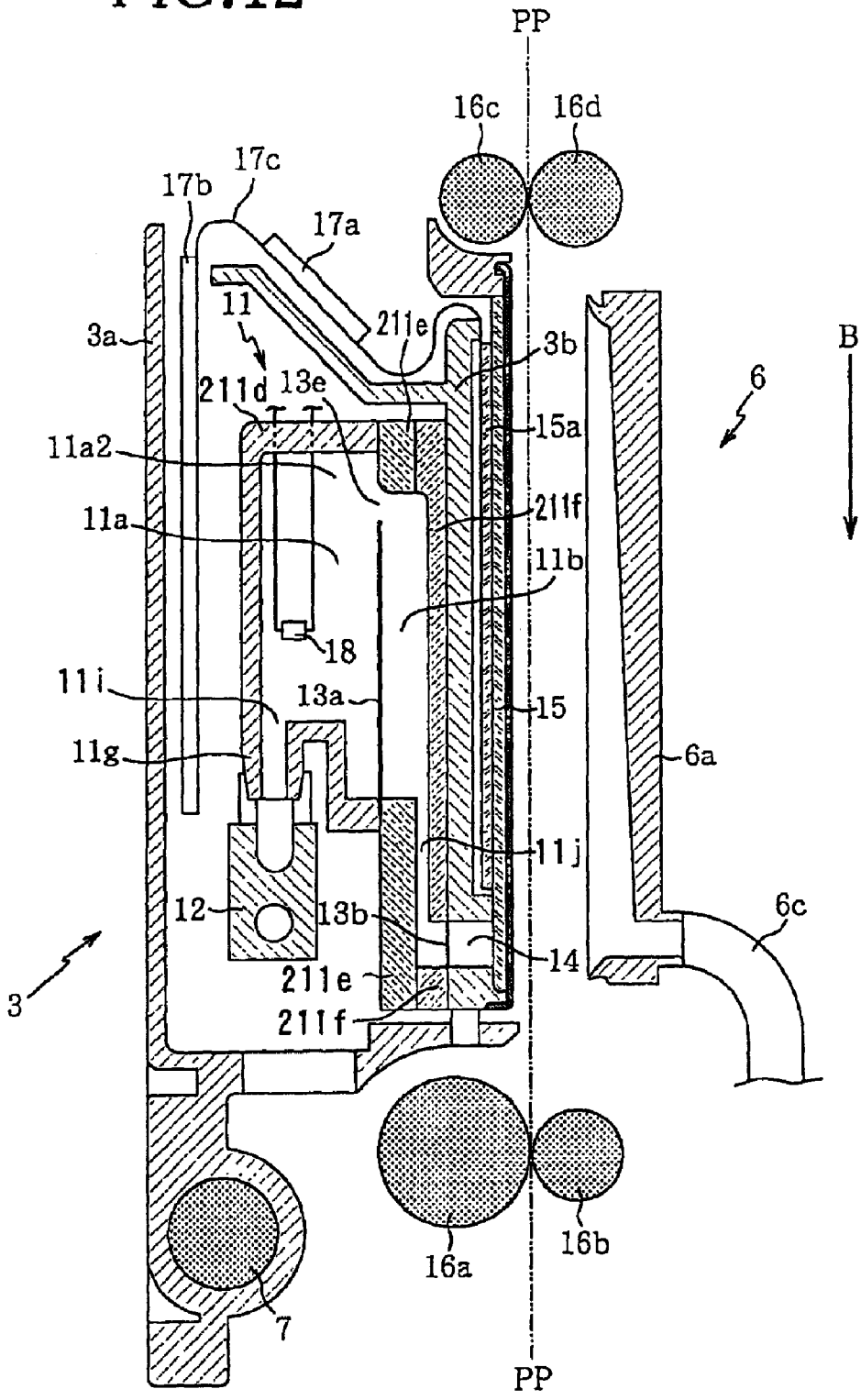
FIG. 12 is a sectional view of a print head unit of a sixth embodiment of the invention.

Referring to FIG. 12, the air trap unit 11 includes an air chamber 11*a*2 provided along the entire ceiling of the first chamber 11*a*. The air chamber 11*a*2 has a bigger capacity than that of the air chamber 11*a*1 in the previously described embodiment. The air chamber 11*a*2 occupies a wider area of the first chamber 11*a* to absorb the pressure waves propagating in the ink passage.

A seventh embodiment of the invention will be described with reference to FIGS. 13 and 14. The parts identical to the counterparts of the first embodiment will be assigned the same reference numerals and explanations will be omitted.

Figure 13:
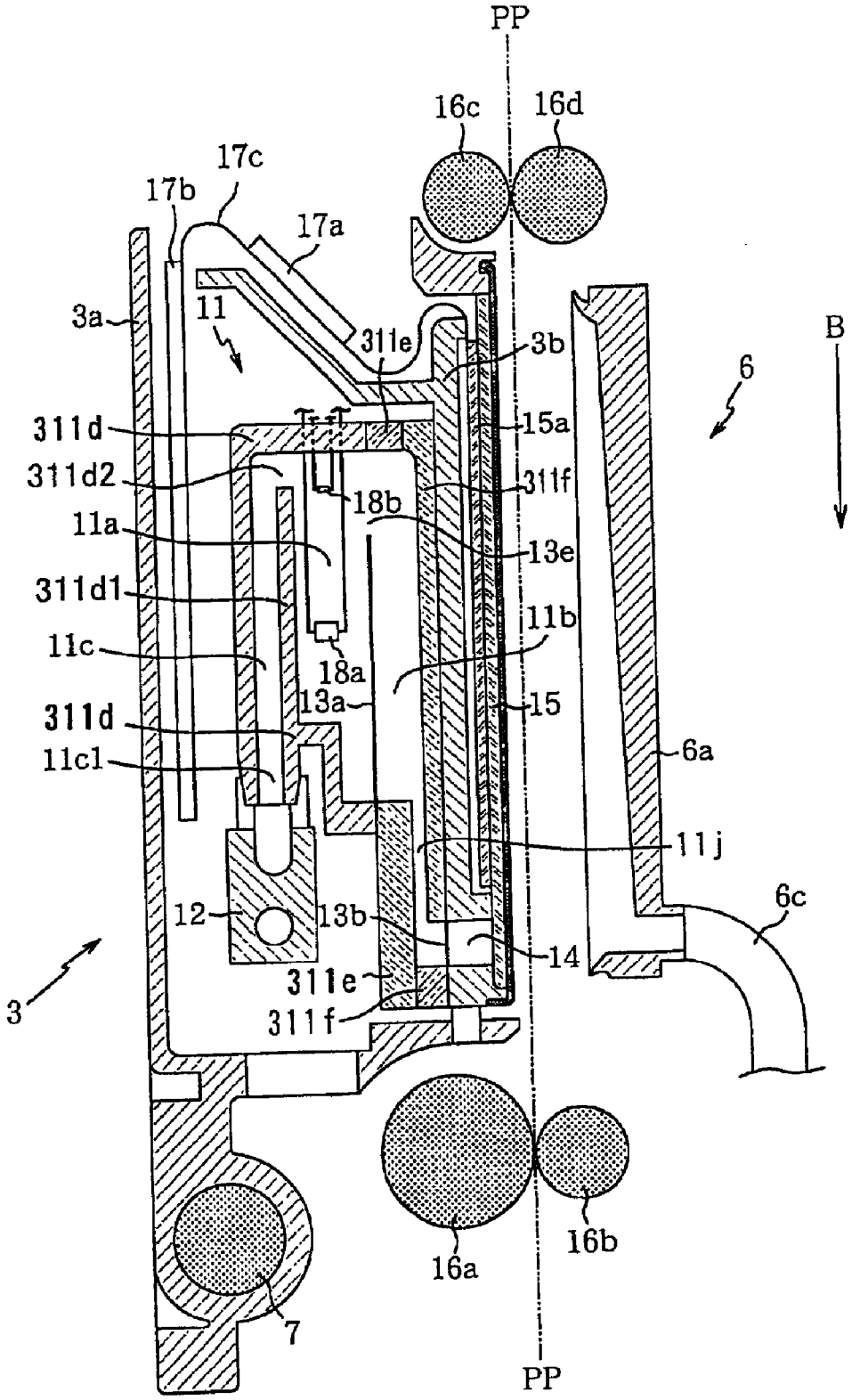
FIG. 13 is a sectional view of a print head unit of a seventh embodiment of the invention.

Referring to FIG. 13, the print heads 15 are supported by the body 3*b* and connected to the air trap chambers 30–33 through the connecting passages 14. Each air trap chamber 30–33 is divided into three chambers which extend vertically, parallel to the body 3, as shown in FIG. 13. A second chamber 11*b* is disposed on the side of the print head 15, a first chamber 11*a* is disposed upstream of the ink passage from the second chamber 11*b*, and a third chamber 11*c* is disposed upstream from the first chamber 11*a*. Air, which has not been removed by the purging operation, is trapped at all times at an upper portion of the first, second, and third chambers 11*a*–11*c*.

The third chamber 11*c* is disposed most upstream of the ink passage in each air trap chamber 30–33 and has, at its bottom, an ink inlet 11*c*1. The joint member 12 is directly connected to the ink inlet 11*c*1 so that ink is supplied from the ink tank 4. The third chamber 11*c* and the first chamber 11*a* are separated by a guide wall 311*d*1. The guide wall 311*d*1 extends vertically from the bottom of third chamber 11*c*.

More specifically, the vertical dimension (in direction B) of the guide wall 311*d*1 is smaller than the vertical inside dimension of each air trap chamber 30–33. Accordingly, the guide wall 311*d*1 is not formed at an upper portion of each air trap chamber 30–33 and an empty space, or gap, 311*d*2 is formed there. Through the empty space 311*d*2, the third chamber 11*c* communicates with the first chamber 11*a*. Air is trapped in this empty space 311*d*2 at all times. The guide wall 311*d*1 is designed to be higher than the first filter 13*a*. The guide wall 311*d*1 continues to the opposed inner walls, extending in the width direction (direction A), of each air trap chamber 30–33.

The guide wall 311*d*1 is made of such a material and formed into such a shape as to inhibit the passage of ink and air therethrough. Thus, ink and air flowing from the ink inlet 11*c*1 into the third chamber 11*c* cannot pass though the guide wall 311*d*1 to the first chamber 11*a* and, instead, moves upwardly along the guide wall 311*d*1 and strikes the air trapped at an upper portion of the third chamber 11*c*. After that, the ink passes through the trapped air and flows into the first chamber 11*a*.

Because the guide wall 311*d*1 is made of a material having high wettability to ink, the air is unlikely to stay at the guide wall 311*d*1. The air flowing into the third chamber 11*c* is guided upwardly along the guide wall 311*d*1 and is trapped at the upper portion of the third chamber 11*c*.

In addition, pressure waves transferred in the ink through the tube 5*a*–5*d* move upwardly along the guide wall 311*d*1 and strike the air trapped at the upper portion of the third chamber 11*c*. As a result, the pressure waves are absorbed by the air. As described above, by trapping the air in the middle of the ink passage defined by the third chamber 11*c* and the first chamber 11*a*, pressure waves generated in the tube 5*a*–5*d*, due to speed changes of the carriage 3*a* during printing, can be reliably absorbed by the air trapped in each air trap chamber 30–33. Thus, the pressure waves are prevented from propagating to each print head 15.

Because the guide wall 311*d*1 is disposed higher than the first filter 13*a*, the ink passage from the first chamber 11*a* to the second chamber 11*b* is formed above the first filter 13*a*. The ink flow pattern (ink passage) in each air trap chamber 30–33 will be described later with reference to FIGS. 14A–14F.

The first chamber 11*a* is defined by the guide wall 311*d*1 and the first filter 13*a*. The first chamber 11*a* and the second chamber 11*b* are not separated completely by the first filter 13*a* and communicates with each other through the upper opening 13*e*. The third chamber 11*c* communicates with the first and second chambers 11*a*, 11*b* through the opening, or gap, 311*d*2 above the guide wall 311*d*1. The ink supplied from the third chamber 11*c* to the first chamber 11*a* is supplied to the second chamber through the first filter 13*a* and the upper opening 13*e*.

The first chamber 11*a* is provided with a first thermistor 18*a* and a second thermistor 18*b*. The first thermistor 18*a* is hung at a first predetermined position from the top of the first chamber 11*a* to detect the ink level in the first chamber 11*a*. The first thermistor 18*a* has a pair of positive and negative electrodes and electricity is supplied thererto continuously. When the thermistor 18*a* is immersed in the ink, the temperature of the thermistor 18*a* does not rise greatly. When the thermistor 18*a* is exposed from the ink in the first chamber 11*a*, the temperature rises greatly. The resistance of the thermistor 18*a* changes when the temperature changes. Thus, the ink level can be detected upon detection of a resistance change of the thermistor 18*a*. The thermistor 18*a* is connected to a signal line of the control circuit provided in the printer body 2. When a resistance change is detected from the signal sent to the control circuit, it is decided that air trapped in the air trap chamber 30–33 has exceeded a predetermined volume. The control circuit sends out a signal to the purge device 6. The purge device 6 conducts the purging operation to remove the air trapped in the air trap chamber 30–33.

The second thermistor 18*b* is hung at a second predetermined position higher than the first thermistor 18*a* (as high as the top of the guide wall 311*d*1). The second thermistor 18*b* has the same structure as the first thermistor 18*a*. When the ink is supplied to the second predetermined position after the purging operation by the purge device 6, the second thermistor 18*b* detects the ink. A detection signal is sent, upon detection of a resistance change, from the second thermistor 18*b* to the control circuit, as with the first thermistor 18*a*.

A rise in the ink level in the first chamber 11*a* after the purging operation by the purge device 6 indicates a decrease in the volume of air trapped in the air trap chamber 30–33. When a resistance change of the thermistor 18*b* is detected from the signal sent to the control circuit, it is decided that the volume of ink in the air trap chamber 30–33 has exceeded a predetermined volume. The control circuit sends out a signal to the purge device 6 to stop the purging operation. The purge device 6 stops purging and a predetermined volume of air is left in the air trap chamber 30–33. Thus, the air remains at the upper portion of the air trap chamber 30–33 (at the opening above the guide wall 311*d*1 between the first chamber 11*a* and the third chamber 11*c*) so as to absorb the pressure waves generated in the ink passage.

Figures 14A, 14B, 14C, 14D, 14E, 14F:
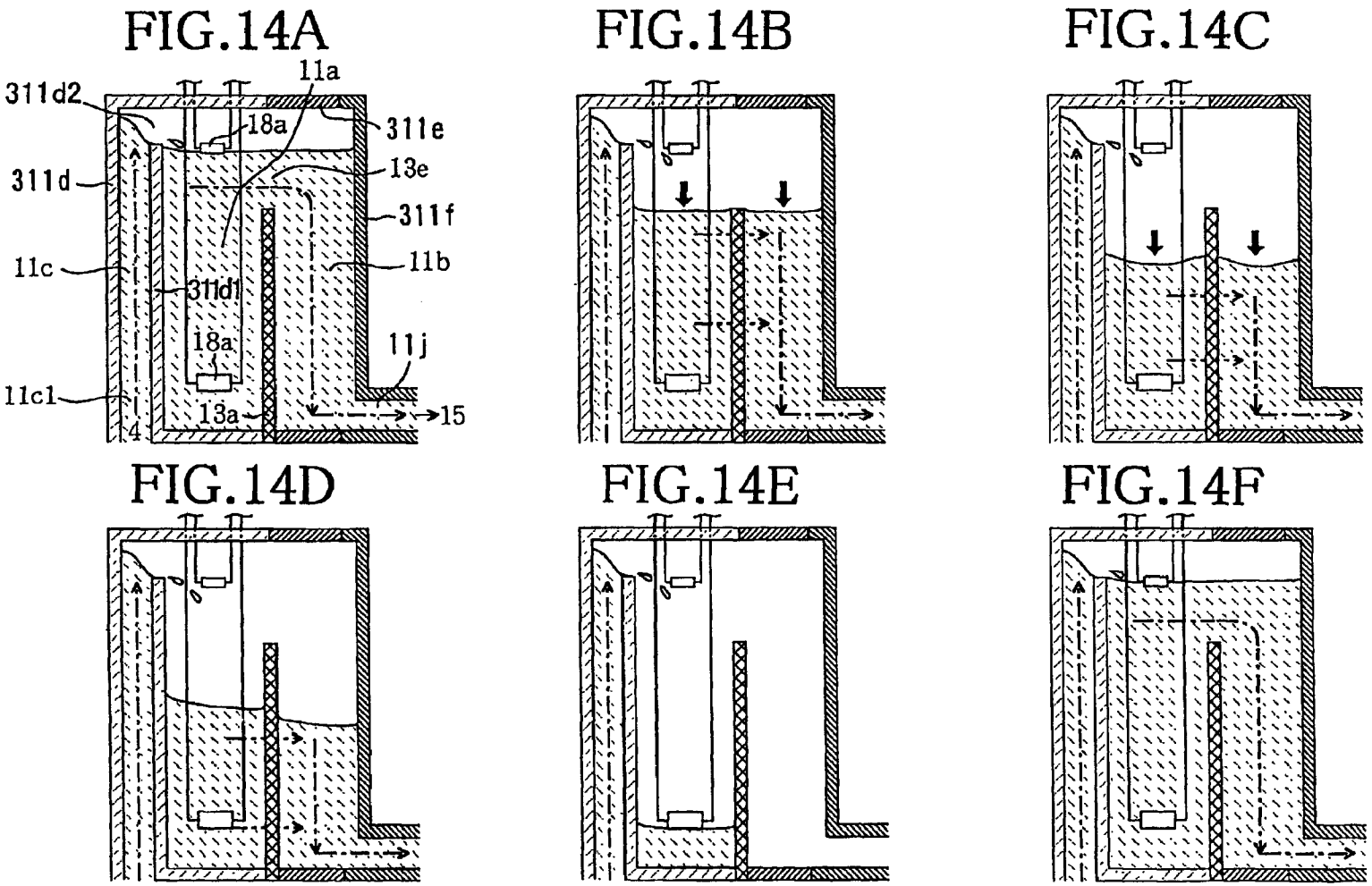
FIGS. 14A–14F are perspective views showing the operation of an air trap unit of the seventh embodiment of the invention.

Referring to FIGS. 14A–14F, the pressure wave propagation pattern, the ink flow pattern, and the air trapped condition in the air trap unit 11 will be described. FIGS. 14A–14F are vertical sectional views of the air trap chamber 30–33 of the print head unit 3 and show the air trap function in schematic form. FIG. 14A shows an initial state immediately after the purging operation where the air trap chamber 30–33 is filled with ink to the predetermined level. Even in the initial state shown in FIG. 14A, air is left at the upper portion of the air trap chamber 30–33 by the functioning of the thermistor 18*b*.

In this case, the ink flow pattern is produced in the air trap chamber 30–33 as described below. As the print head 15 ejects ink, the ink levels in the first and second chambers 11*a*, 11*b* fall, and the pressure is reduced in the first and second chambers 11*a*, 11*b*. As a result, ink in the ink tank 4, tube 5*a*–5*d*, joint member 12, and third chamber 11*c* is drawn upwardly into the air trap chamber 30–33 along the guide wall 311*d*1 and is supplied, over the top end of the guide wall 311*d*1, to the first chamber 11*a*. Then, the ink flows, over the top end of the first filter 13*a*, into the second chamber 11*b* because the opening 13*e* (formed above the first filter 13*a*) between the first and second chambers 11*a*, 11*b* has less resistance to the ink flow than the first filter 13*a*. The ink flowing into the second chamber 11*b* is supplied to the corresponding print head 15 through the guide nozzle 11*j*.

Pressure waves generated in the tube 5*a*–5*d* due to speed changes of the carriage 3*a* propagate to the third chamber 11*c* through the ink inlet 11*c*1. Then, the pressure waves propagate along the guide wall 311*d*1 and strike the air trapped at the upper portion of the air trap chamber 30–33, thereby being absorbed by the air.

FIG. 14B shows a state where the volume of air trapped in the air trap chamber 30–33 is increased to some extent. After the ink flows from the third chamber 11*c* to the first chamber 11*a*, the resistance of the first filter 13*a* interferes with direct ink flow from the first chamber 11*a* to the second chamber 11*b*. Thus, the air contained in the ink moves up by its own buoyancy and is trapped at the upper portion of the air trap chamber 30–33. The air trapped there is not discharged by suction force generated when the print head 15 ejects ink. As a result, the air gradually fills the air trap chamber 30–33 and lowers the ink level in the first and second chambers 11*a*, 11*b*, as shown in FIGS. 14B–14D.

Even when the ink level falls below the top end of the first filter 13*a*, the ink is supplied from the first chamber 11*a* to the second chamber 11*b* through the first filter 13*a*. The hole opening's diameter and the area of the first filter 13*a* are appropriately set to ensure a sufficient ink supply until the ink level falls to the predetermined level.

In this state, the pressure waves generated in the tube 5*a*–5*d* are absorbed by the air trapped at the upper portion of the air trap chamber 30–33.

Shortly before an insufficient supply of ink to the ink jet head 15 occurs, the thermistor 18*a* starts being exposed above the ink surface. As described above, the purge device 6 conducts the purging operation when the resistance of thermistor 18*a* changes. During the purging operation, a high suction force is applied to the second chamber 11*b*, and thus the ink, when passing through the first filter 13*a*, undergoes extremely high resistance to the ink flow. As a result, the ink flow passing through the opening 13*e* (above the first filter 13*a*) between the first and second chambers 11*a*, 11*b* is generated, thereby discharging the air trapped in the air trap chamber 30–33. Then, when the ink level reaches the second predetermined level, the second thermistor 18*b* detects the ink level and the purging operation is stopped. Thus, the air in the air trap chamber 30–33 is not discharged completely, and the remaining air can absorb the pressure waves generated even immediately after the purging operation.

As described above, the pressure waves generated in the ink passage are guided along the guide wall 311*d*1 and are absorbed by the air trapped at the upper portion of the air trap chamber 30–33, instead of propagating to the corresponding print head 15. Accordingly, the meniscus formed in the ink nozzle is maintained to accomplish constant ink ejection, and high print quality can be ensured.

An eighth embodiment of the invention will be described with reference to FIGS. 15–17. The parts identical to the counterparts of the first embodiment will be assigned the same reference numerals and explanations thereof will be omitted.

Figure 15:
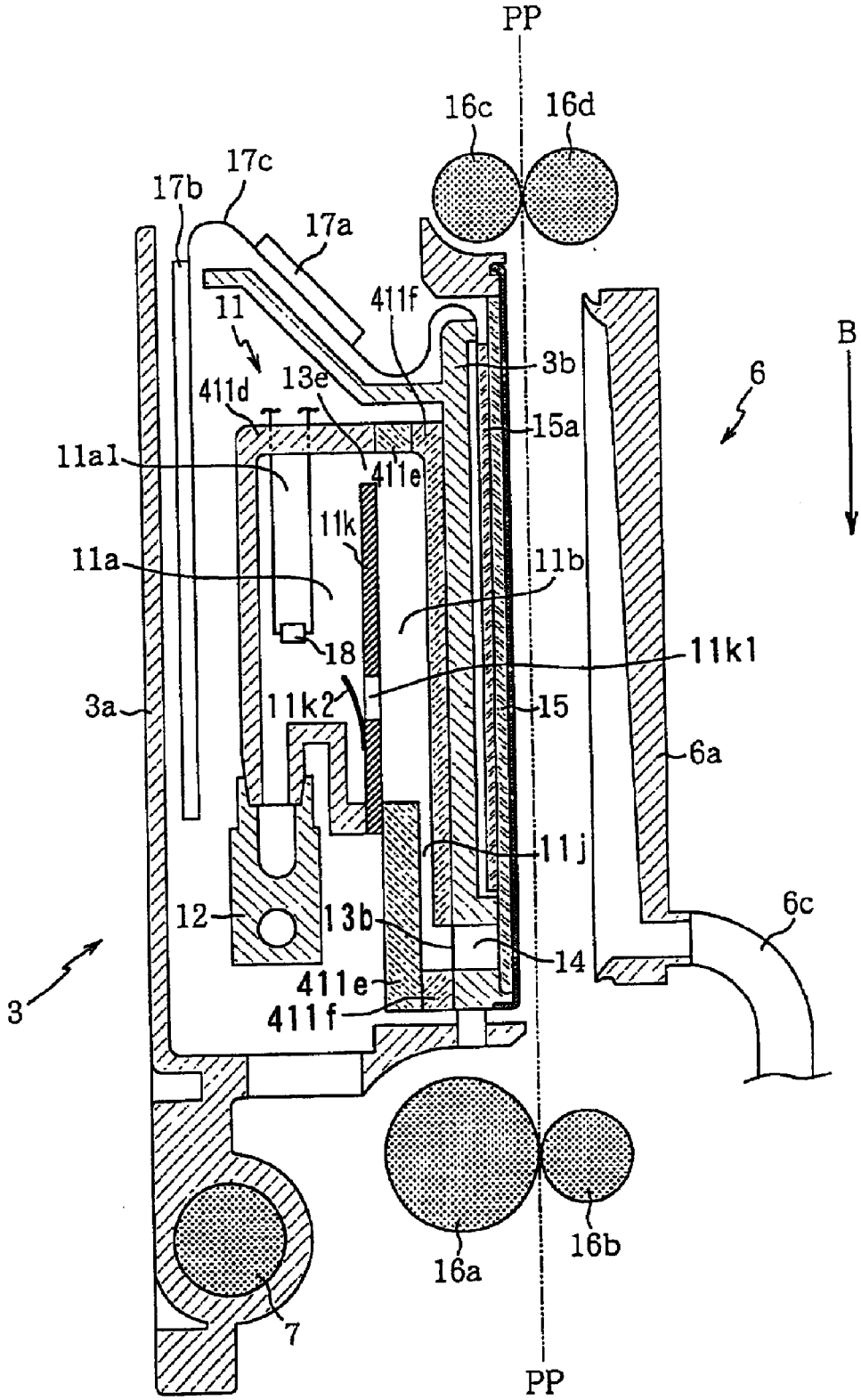
FIG. 15 is a sectional view of a print head unit of an eighth embodiment of the invention.

Referring to FIG. 15, a wall 11*k* divides the lower portion of each air trap chamber 30–33 into the first and second chambers 11*a*, 11*b* at such a position that the volume of the second chamber 11*b* is smaller than that of the first chamber 11*a* or about half of the first chamber 11*a*. The wall 11*k* extends vertically, parallel to the body 3*b* of the print head unit 3. The wall 11*k* is placed parallel to the moving direction A of the carriage 3*a* and the long side of the wall 11*k* is placed in the vertical direction B of the carriage 3*a*. The length of the longer side of the wall 11*k* in direction B is formed shorter than the inner length of the air trap unit 11. The height of the wall 11*k* is shorter than the length of each air trap chamber 30–33 to form the opening 13*e*. The opening 13*e* allows ink to communicate between the first and second chambers 11*a*, 11*b* with less resistance. The width of the wall 11*k* is long enough to extend from side to side of the air trap chamber 30–33, to prevent air introduced into the first chamber 11*a* from entering into the second chamber 11*b*. Each air trap chamber 30–33 and the wall 11*k* are placed in the vertical direction so that air introduced into each air trap chamber 30–33 goes up along the first chamber 11*a* and is trapped at the top portion of the first chamber 11*a* because the wall 11*k* does not allow air to go through the wall 11*k*. Because the wall 11*k* is made of a material having wettability to ink, the air is unlikely to stay at the wall 11*k* but is likely to rise in the first chamber 11*a*.

At a lower portion of the wall 11*k*, a circular ink hole 11*k*1 is provided to go through the wall 11*k*. On the side of the first chamber 11*a*, the ink hole 11*k*1 is provided with a film 11*k*2. The film 11*k*2 is fixed at its lower side to the wall 11*k* by thermal fusion. The film 11*k*2 is elastically opened on its upper side to uncover the ink hole 11*k*1. The film 11*k*2 is closed to cover the ink hole 11*k*1 when the purge device 6 generates pressure applied to the film 11*k*2. Because the film 11*k*2 is fixed to the wall 11*k* at its lower side, air is unlikely to stay at the film 11*k*2.

Figure 16:
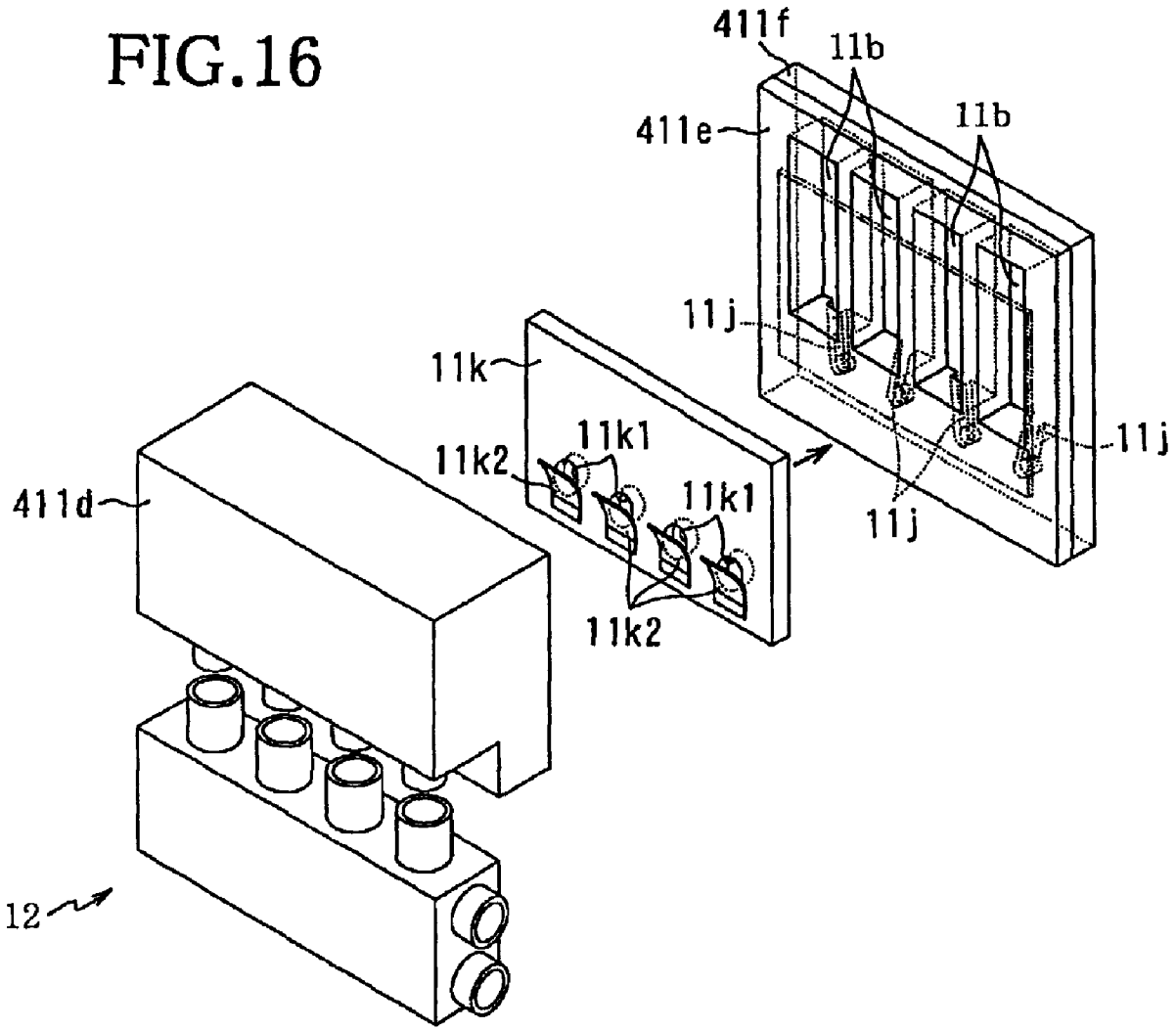
FIG. 16 is a disassembled perspective view of an air trap unit of the eighth embodiment of the invention.

Referring to FIG. 16, the air trap unit 11 and the joint member 12 are described. The air trap unit 11 comprises three parts 411*d*–411*f*. Each of the parts 411*d*–411*f* are formed to have four air trap chambers 30–33, corresponding to the four ink tubes 5*a*–5*d*. The parts 411*d*–411*f* are made of thermoplastic resin considering various factors, such as moldability, resistance to solvents, resistance to contamination, chip resistance, and wettability to ink.

The wall 11*k* is fixed by thermal fusion to the part 411*e* to operate as the wall 11*k* for each air trap chamber 30–33. The single wall 11*k* provides four walls for the air trap chambers 30–33 so that the wall 11*k* for the four air trap chambers 30–33 is made at once by thermal fusion of the wall 11*k* to the part 411*e*.

The width of the wall 11*k* corresponds to the total width of the series of the four air trap chambers 30–33 in addition to the fusion areas on both sides. The height of the wall 11*k* corresponds to a height of the first filter to cover a predetermined lower area of each air trap chamber 30–33 in addition to the fusion area. The wall 11*k* is fixed to the part 411*e* by thermal fusion in such a position as to provide an opening at the upper portion of the part 411*e* which comprises the second chamber. Thus the wall 11*k* is placed so as to divide the air trap chambers 30–33 into the first chambers 11*a* and the second chambers 11*b*.

The wall 11*k* is provided with ink holes 11*k*1 and films 11*k*2 corresponding to the air trap chambers 30–33.

Figure 17A:
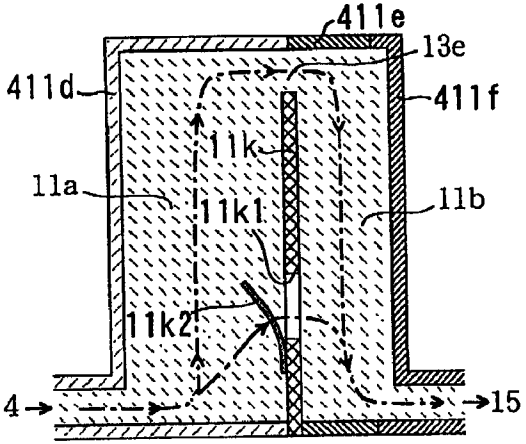
FIGS. 17A–17F are perspective views showing the operation of the air trap unit of the eighth embodiment of the invention.

Referring to FIGS. 17A–17F, the ink flow pattern and the condition of trapped air will be described. FIG. 17A shows an initial state of the air trap unit 11 immediately after the purging operation. In FIG. 17A, as the ink is consumed at the print heads 15, ink supplied from the ink tank 4 to the first chamber 11*a* goes into the second chamber 11*b* over the wall 11*k* through the opening portion 13*e* where the wall 11*k* is not provided, and through the ink hole 11*k*1.

Figure 17B:
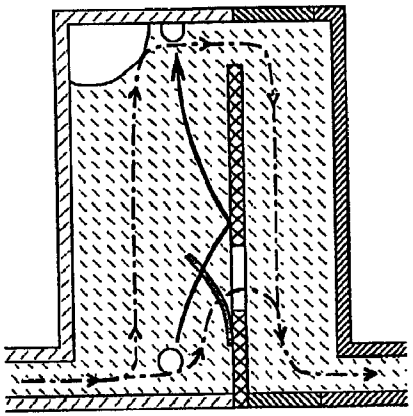

In FIG. 17B, when a small amount of air goes into the first chamber 11*a* of each air trap chamber 30–33, air is unlikely to stick to the wall 11*k* because of good ink wettability of the wall 11*k*. Because each air trap chamber 30–33 is placed in the vertical direction, air rises by its buoyancy along the ink flow.

The inner wall of the first chamber 11*a* is formed of a material having less ink wettability as compared with the inner wall of the second chamber 11*b* so that air stays in the first chamber 11*a* rather than the second chamber 11*b*. When the volume of air trapped in the chambers 11*a*, 11*b* is relatively small, the opening 13*e* between the first chamber 11*a* and the second chamber 11*b* is not blocked by the trapped air. The ink supplied to the first chamber 11*a* flows into the second chamber 11*b* through the opening 13*e*. The speed of the ink flow directed to the print head 15 or the suction force applied to the ink is not fast enough to push the trapped air out from the chambers 11*a*, 11*b*.

Figure 17C:
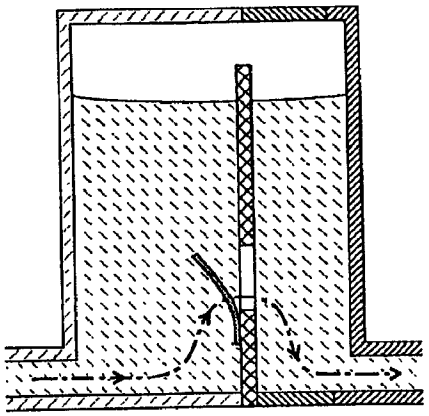

In FIG. 17C, the trapped air becomes large enough to block the opening 13*e* between the first and second chambers 11*a*, 11*b*. The ink supplied to the first chamber 11*a* is blocked and cannot pass into the second chamber 11*b* through the opening 13*e*. Once the opening 13*e* is blocked by the trapped air, the ink starts passing through the ink hole 11*k*1 of the wall 11*k*, as shown in FIG. 17C. The film 11*k*2 is set to be strong enough to remain open against the ink flow going through the ink hole 11*k*1 .

Figure 17D:
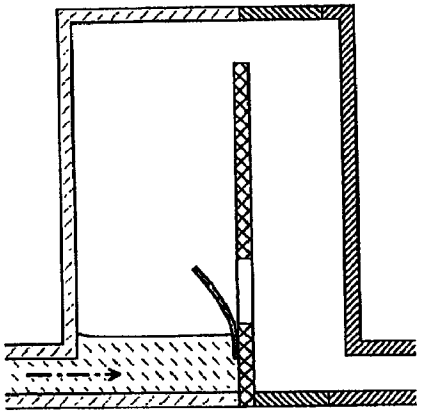

In FIG. 17D, the volume of the trapped air becomes larger and pushes the ink level down in the chambers 11*a*, 11*b*. The ink level goes below the ink hole 11*k* and the ink is not supplied to the print head 15.

Figure 17E:
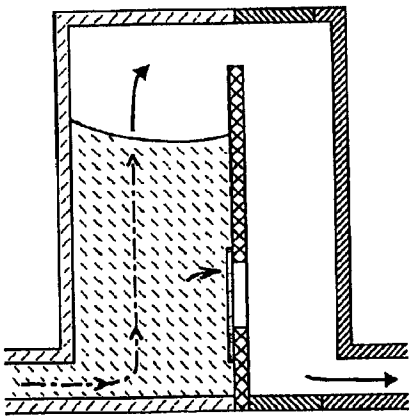
Figure 17F:
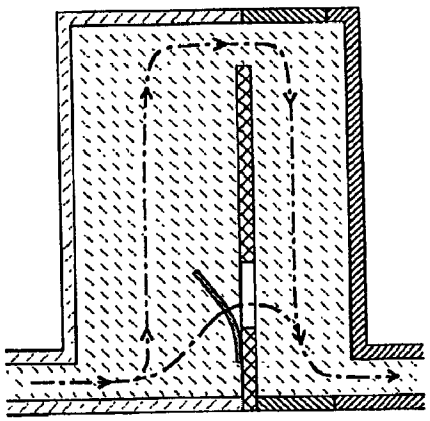

In FIG. 17E, the purging operation is conducted by the purge device 6 to discharge the trapped air. During the purging operation, because a strong suction force is applied to the second chamber 11*b*, the resistance to the ink flow going through the ink hole 11*k*1 becomes very large. Because pressure is applied to the film 11*k*2 toward the print head 15, the film 11*k*2 is moved to close the ink hole 11*k*1. By closing the ink hole 11*k*1 by the film 11*k*2, ink in the first chamber 11*a* is not allowed to pass into the second chamber 11*b* through the ink hole 11*k*1. Thus a strong ink flow passing through the opening 13*e* between the first and second chambers 11*a*, 11*b* is generated to discharge the trapped air in each air trap chamber 30–33 to the outside. The first and second chambers 11*a*, 11*b* are refilled with ink as shown in FIG. 17F.

In the above embodiment, the film 11*k*2 provided with the wall 11*k*1 acts as a valve member in the air trap unit 11. Air generated in the ink passage, such as the tube 5*a*–5*d*, the joint member 12, and the print head 15, is trapped in each air trap chamber 30–33, and the trapped air is purged by the purge device 6 to recover the function of each air trap chamber 30–33. The purging operation is conducted when the thermistor 18 detects a need for the purging operation. The purge device 6 conducts the purging operation efficiently and saves ink consumption.

A ninth embodiment of the invention will be described with reference to FIGS. 18A–18C. In this embodiment, the film 11*k*2 in the eighth embodiment is replaced with a valve 11*k*3. The parts identical to the counterparts of the previously explained embodiments will be assigned the same reference numerals and explanations thereof will be omitted.

Figure 18A:
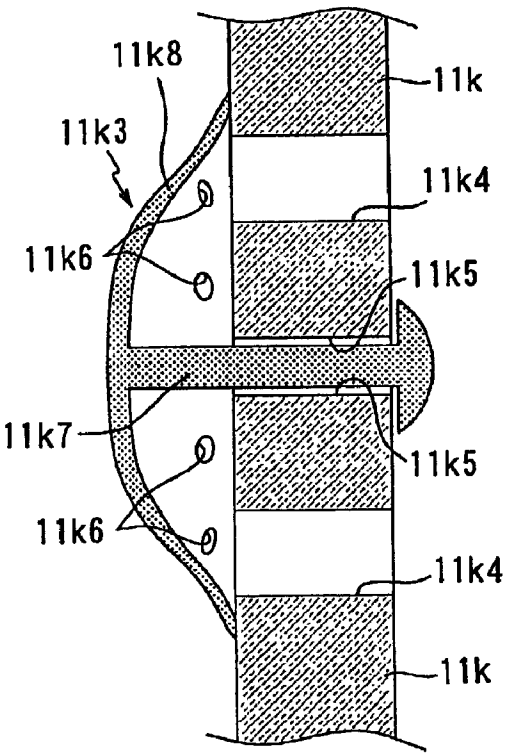
FIGS. 18A–18C are enlarged sectional views of a film of the ninth embodiment of the invention.

Referring to FIG. 18A, the valve 11*k*3 is formed of an elastic material into a shape of umbrella. A shaft 11*k*7 of the umbrella valve 11*k*3 is slidably inserted into a hole 11*k*5 that is located at the center between ink holes 11*k*4 provided at the lower portion of the wall 11*k*. The valve 11*k*3 is supported by the hole 11*k*5 so that the valve 11*k*3 slides perpendicularly to the wall 11*k*. The umbrella 11*k*8 is disposed in the first chamber 11*a*.

Figure 18B:
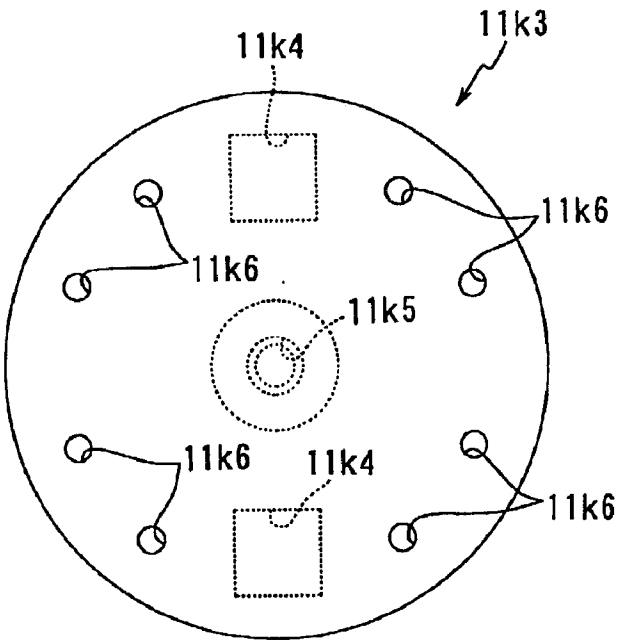

Referring to FIG. 18B, the umbrella 11*k*8 of the valve 11*k*3 is provided with holes 11*k*6. The umbrella 11*k*8 is of a cone shape or a dome shape to cover the holes 11*k*4. The center of the umbrella 11*k*8 moves toward the wall 11*k* and the outer edge of the umbrella 11*k*8 slides on the wall 11*k*. The holes 11*k*6 of the umbrella 11*k*8 are placed so as to not face the ink holes 11*k*4 when the center of the umbrella 11*k*8 contacts the wall 11*k*. The holes 11*k*6 are closed by the wall 11*k*, and the ink holes 11*k*4 are closed by the umbrella 11*k*8 of the valve 11*k*3.

The ink flow, when the print head 15 performs printing, is not fast enough to push the umbrella 11*k*8 to close. The ink flows from the first chamber 11*a* through the holes 11*k*6 and ink holes 11*k*4 to the second chamber 11*b*.

Figure 18C:
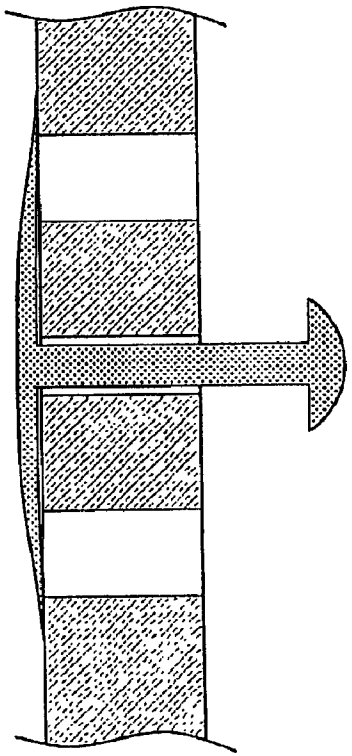

FIG. 18C shows the valve 11*k*3 during the purging operation by the purge device 6. When the purge device 6 conducts the purging operation, a strong suction force is applied to the second chamber 11*b*. A resistance to the ink at the ink hole 11*k*4 is very high and pressure is applied to the valve 11*k*3 toward the print head 15. The center of the valve 11*k*3 moves toward the wall 11*k*, so that the holes 11*k*6 are closed by the wall 11*k* and the ink holes 11*k*4 are closed by the umbrella 11*k*3. The ink is prohibited from going from the first chamber 11*a* to the second chamber 11*b* through the holes 11*k*4. When the purge device conducts the purging operation, a strong ink flow is generated to pass through the portion connecting the first and second chambers 11*a*, 11*b* which corresponds to the opening 13*e* where the top portion of the wall 11*f* is not provided. Air trapped in each air trap chamber 30–33 is discharged by the ink flow. Thus, air generated in the ink passage, such as the tube 5*a*–5*d*, the joint member 12, and the print head 15, is trapped in each air trap chamber 30–33 and the trapped air is discharged by the purge device 6 to recover the function of each air trap chamber 30–33.

A tenth embodiment of the invention will be described with reference to FIGS. 19A and 19B. In this embodiment, the film 11*k*2 in the eighth embodiment is replaced with a floating member, such as a floating ball 11*k*9. The parts identical to the counterparts of the previously explained embodiments will be assigned the same reference numerals and explanations thereof will be omitted.

Figure 19B:
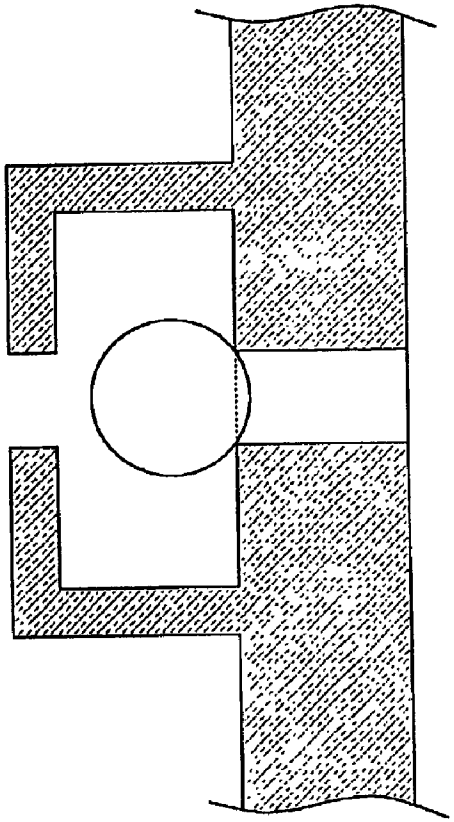
FIGS. 19A and 19B are enlarged sectional views of a ball valve of the tenth embodiment of the invention.
Figure 19A:
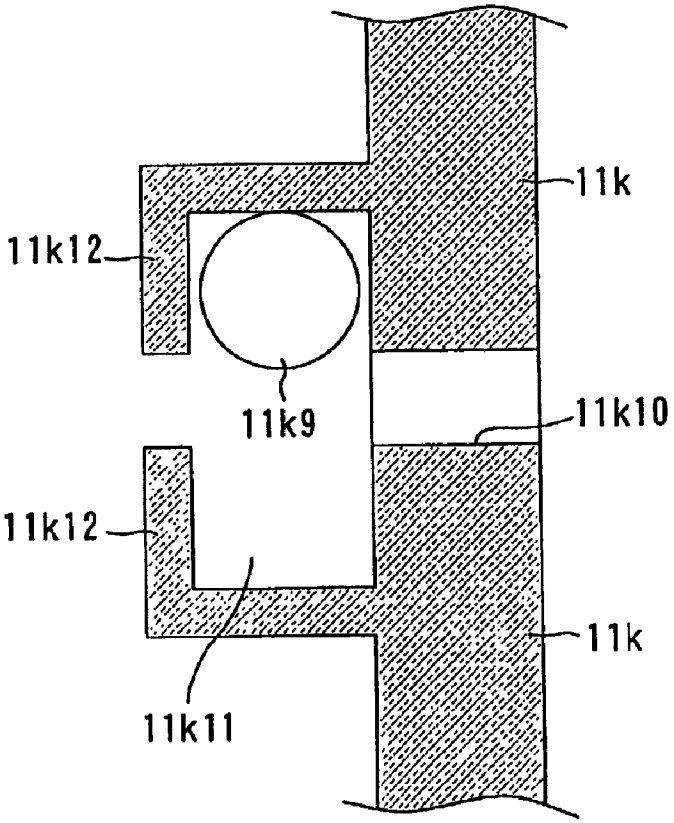

Referring to FIG. 19A, an ink hole 11*k*10 is provided to pass ink therethrough. On the side of the first chamber 11*a*, a room 11*k*11 defined by a housing 11*k*12 is provided. In the room 11*k*11 the ball 11*k*9 is installed. The ball 11*k*9 is larger than the hole 11*k*10 and is made of a material whose gravity is lighter than that of ink. The ball 11*k*9 floats in the ink to open the hole 11*k*10. When the print head 15 performs printing, an ink flow is generated, however, the ink flow is not strong enough to move the ball 11*k*9 to close the hole 11*k*10.

Referring FIG. 19B, when the purge device 6 conducts the purging operation, a strong suction force is generated in the second chamber 11*b*. A large resistance is applied to ink going through the ink hole 11*k*10, so that the ball 11*k*9 is moved to close the ink hole 11*k*10. When the purge device 6 conducts the purging operation, a strong ink flow is generated to pass through a portion connecting the first and second chambers 11*a*, 11*b* which corresponds to a portion where the opening 13*e* of the top portion of the wall 11*f* is provided. Air trapped in the air trap chambers 30–33 is discharged by the ink flow. Thus, air generated in the ink passage, such as the tubes 5*a*–5*d*, the joint member 12, and the print head 15, is trapped in each air trap chamber 30–33 when the print head 15 performs printing. The trapped air is discharged by the purge device 6 in order to recover the function of each air trap chamber 30–33.

An eleventh embodiment of the invention will be described with reference to FIGS. 21–24. The parts identical to the counterparts of the first embodiment will be assigned the same reference numerals and explanations will be omitted.

Figure 20:
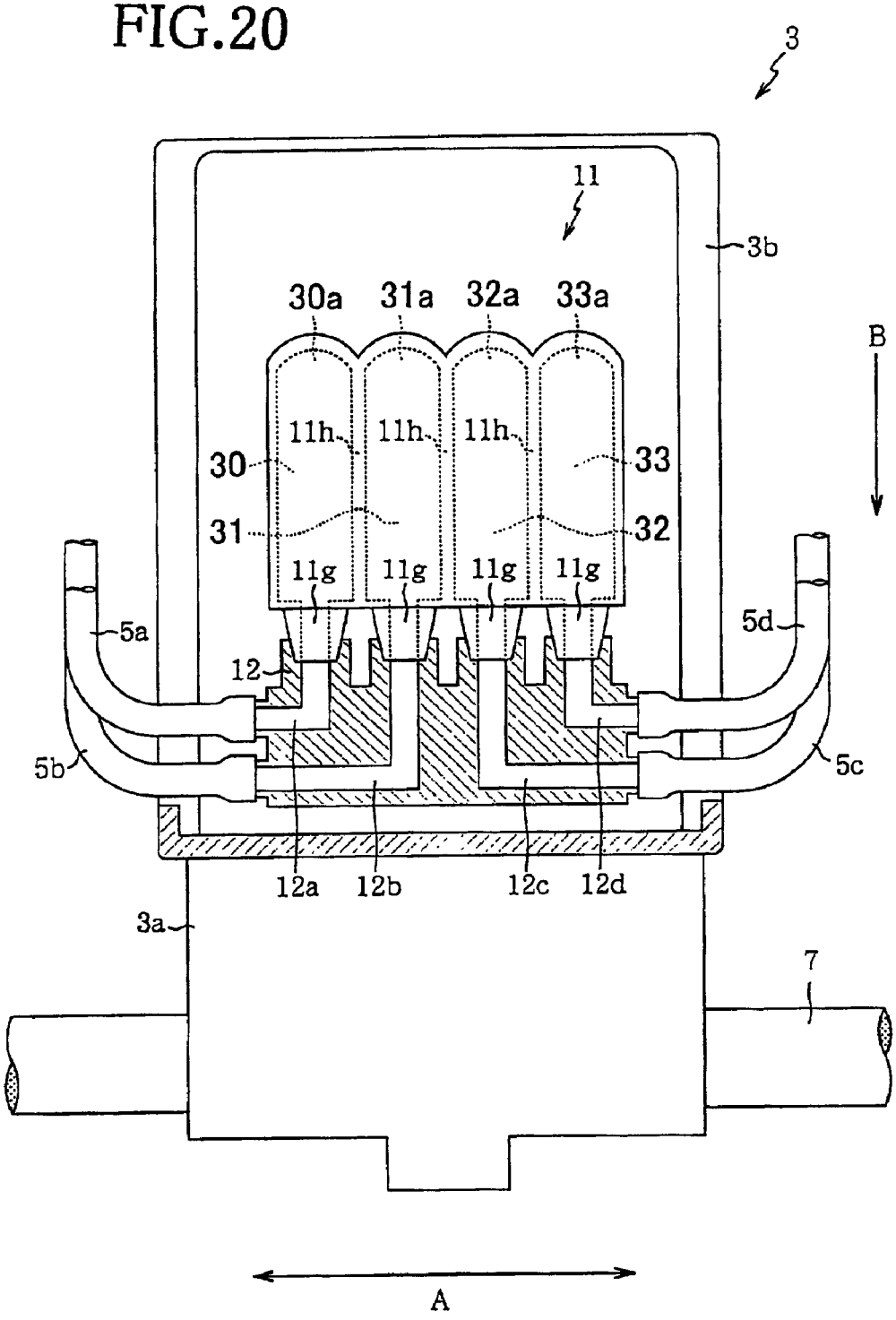
FIG. 20 is a sectional view of a print head unit of an eleventh embodiment of the invention.

Referring to FIG. 20, the carriage 3*a* is provided with a body 3*b* for accommodating an air trap unit 11 and a joint member 12. The air trap unit 11 includes the four air trap chambers 30–33 that trap air generated in the ink passage while ink is supplied from the corresponding ink tanks 4*a*–4*d*. Each air trap chamber 30–33 has an inner convex or upwardly-curved top surface 30*a*–33*a*. The air generated in the ink passage is trapped in the top portions of the air trap chambers 30–33 along the curved top surfaces thereof.

Figure 21:
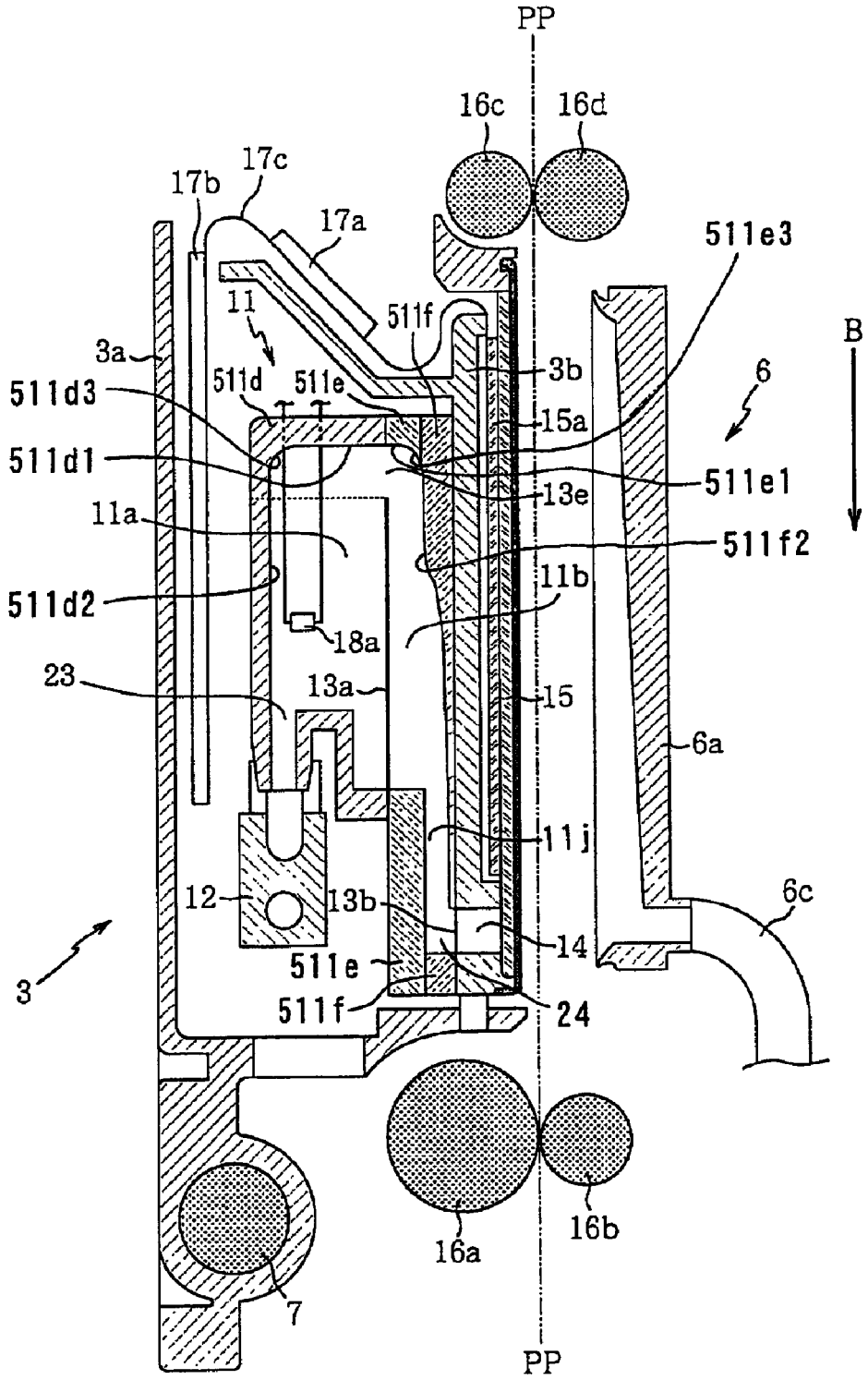
FIG. 21 is a sectional view of a print head unit of the eleventh embodiment of the invention.

Referring to FIG. 21, the first chamber 11*a* is separated by the first filter 13*a* from the second chamber 11*b*. The first chamber 11*a* is located on the side of the ink tank 4, upstream of the ink passage. The first filter 13*a* separating the two chambers 11*a*, 11*b* is provided so as to form the opening 13*e* at an upper portion of each air trap chamber 30–33, so that the first and second chambers 11*a*, 11*b* are fluidly communicated. An inner top surface 511*d*1 and an inner side surface 511*d*2 of the first chamber 11*a* are connected to form a curved corner 511*d*3. In addition, the first and second chambers 11*a*, 11*b* are connected so as to align each top portion of the chambers 11*a*, 11*b*. The ink supplied from the ink tank 4*a*–4*d* through the corresponding ink tube 5*a*–5*d* is introduced into the first chamber 11*a* through an ink inlet 23 formed at a bottom portion of the first chamber 11*a*. The ink introduced into the first chamber 11*a* is supplied to the second chamber 11*b* through the first filter 13*a* or the opening 13*e* provided above the first filter 13*a*, as will be described in more detail below with reference to FIGS. 23A through 23F. The air flowing into the first chamber 11*a*, together with the ink, rises by its buoyancy along the curved corner 511*d*3 of the air trap chamber 30–33 and is trapped at the upper portion of the first chamber 11*a*. As the amount of the trapped air becomes large, the air is spread over the upper portions of both of the first and second chambers 11*a*, 11*b* by the ink flow and the upper portion of each air trap chamber 30–33 is filled with the trapped air.

The second chamber 11*b* is fluidically connected to the first chamber 11*a*, so as to align the inner top surface 511*e*1 of the second chamber 11*b* with the inner top surface 511*d*1 of the first chamber 11*a*. The second chamber 11*b* has a tapered inner side surface 511*f*2 gradually becoming wider toward the bottom of the chamber 11*b*. The inner top surface 511*e*1 and the inner side surface 511*f*2 of the second chamber 11*b* are connected to form a curved corner 511*e*3. This structure enables the ink or trapped air to flow smoothly from the first chamber 11*a* to the second chamber 11*b*. Further, the trapped air is smoothly discharged by the purging operation, without stagnating at the curved corner 511*e*3 of the second chamber 11*b*.

Figure 22:
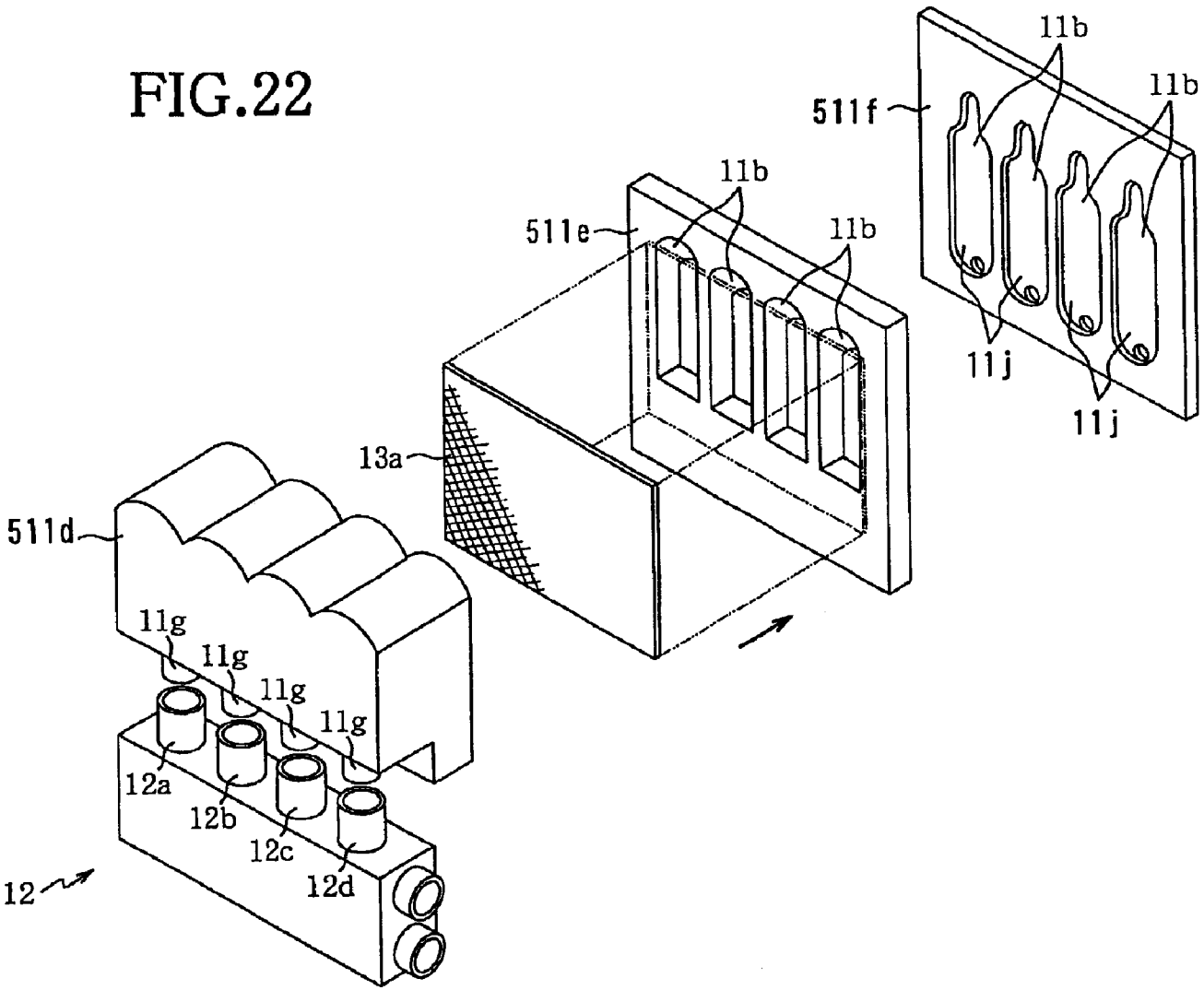
FIG. 22 is a disassembled perspective view of an air trap unit of the eleventh embodiment of the invention.

As shown in FIG. 22, the air trap unit 11 includes three parts 511*d*–511*f*. The part 511*d* is provided with the four first chambers 11*a* divided by the partitions 11*h*, as shown in FIG. 20. The part 511*e* has four openings as the consecutive four second chambers 11*b*. The part 511*f* has four recessed portions corresponding to the four openings of the part 511*e* and forms the four second chambers 11*b* together with the part 511*e*.

Figure 23A:
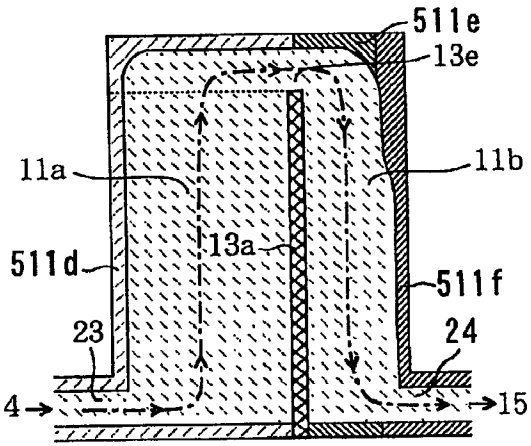
FIGS. 23A–23F are perspective views showing the operation of the air trap unit of the eleventh embodiment of the invention.

Referring to FIGS. 23A–23F, ink flow patterns and the condition of the trapped air will be described. FIG. 23A shows an initial condition of the air trap unit 11 immediately after the purging operation. In FIG. 23A, as ink is consumed at the print head 15, ink supplied from the ink tank 4 to the first chamber 11*a* goes into the second chamber 11*b* over the first filter 13*a* or through the opening 13*e* where the first filter 13*a* is not provided. The opening 13*e* has less resistance to the ink flow than the first filter 13*a* to promote such ink flow.

Figure 23B:
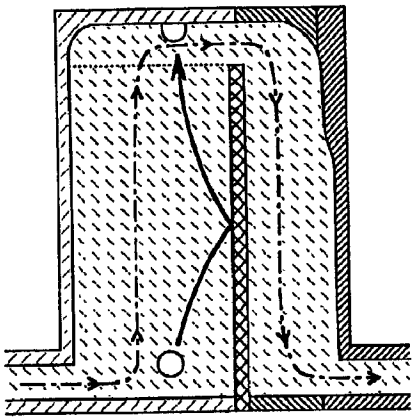

In FIG. 23B, when a small amount of air enters the first chamber 11*a* of the air trap chamber 30–33, air is unlikely to stick to the first filter 13*a* because of good ink wettability of the first filter 13*a*. In addition, because the air trap chamber 30–33 is placed in the vertical direction, air rises by its buoyancy along the ink current flow. Further, because the openings of the first filter 13*a* are smaller than the size of air bubbles, the air bubbles do not pass through the openings of the filter 13*a*, but rise along the ink flow.

The inner wall of the first chamber 11*a* is formed with material having less ink wettability compared to the inner wall of the second chamber 11*b*, so that the air generally stays in the first chamber 11*a* rather than the second chamber 11*b*. When the volume of air trapped in the chambers 11*a*, 11*b* is relatively small, the opening 13*e* between the first chamber 11*a* and the second chamber 11*b* is not blocked by the trapped air. The ink supplied into the first chamber 11*a* flows into the second chamber 11*b* through the opening 13*e*. The speed of the ink flow supplied to the print head 15 or suction force of the ink during printing is not fast enough to push the trapped air from the chambers 11*a*, 11*b*.

Figure 23C:
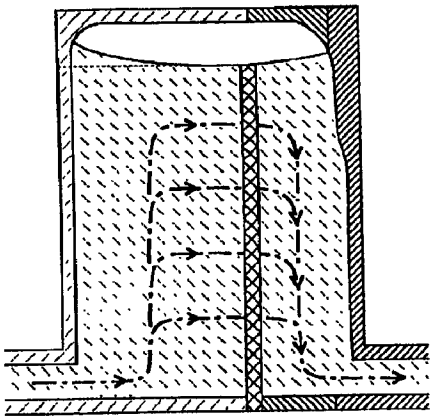

In FIG. 23C, the trapped air becomes large enough to block the opening 13*e* between the first and second chambers 11*a*, 11*b*. The ink supplied to the first chamber 11*a* is blocked from passing into the second chamber 11*b* through the opening 13*e*. Once the opening 13*e* is closed by the trapped air, ink passes through the first filter 13*a*, as shown in FIG. 23C.

Figure 23D:
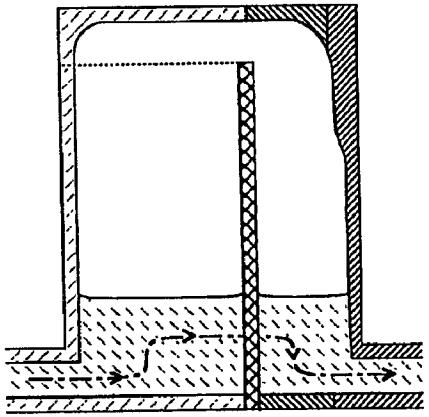

In FIG. 23D, the volume of the trapped air becomes larger, pushing the level of ink surface in the chambers 11*a*, 11*b* down. The area of the first filter 13*a* and its openings are set to keep supplying ink even if the level of the ink surface lowers to a predetermined level.

Figure 23E:
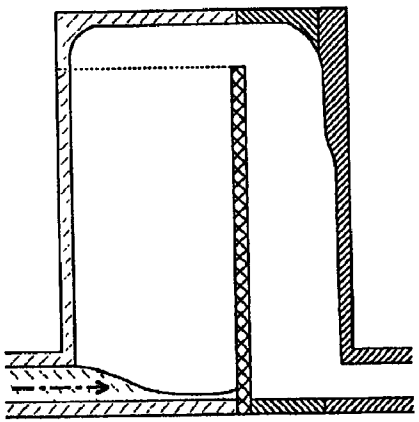

In FIG. 23E, the volume of the trapped air becomes large enough to fill the second chamber 11*b*. In this condition, ink is not supplied to the print head 15.

Figure 23F:
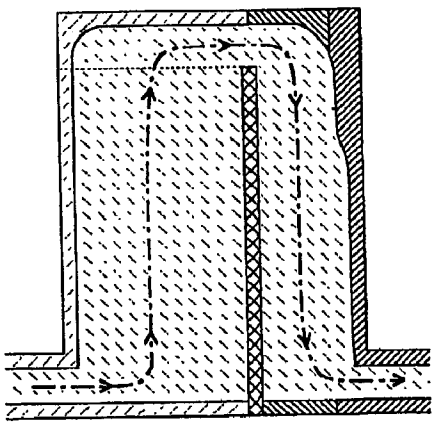

In FIG. 23F, the purging operation is conducted by the purge device 6, so that the trapped air is discharged. During the purging operation, because a strong suction force is applied to the second chamber 11*b*, the resistance to the ink flow passing through the first filter 13*a* becomes very large. Thus, a strong ink flow passing through the opening 13*e* between the first and second chambers 11*a*, 11*b* is generated to discharge the trapped air in the air trap chamber 30–33 to the outside. Ink is refilled into the first and second chambers 11*a*, 11*b*, similar to the initial condition shown in FIG. 23A.

Figure 24:
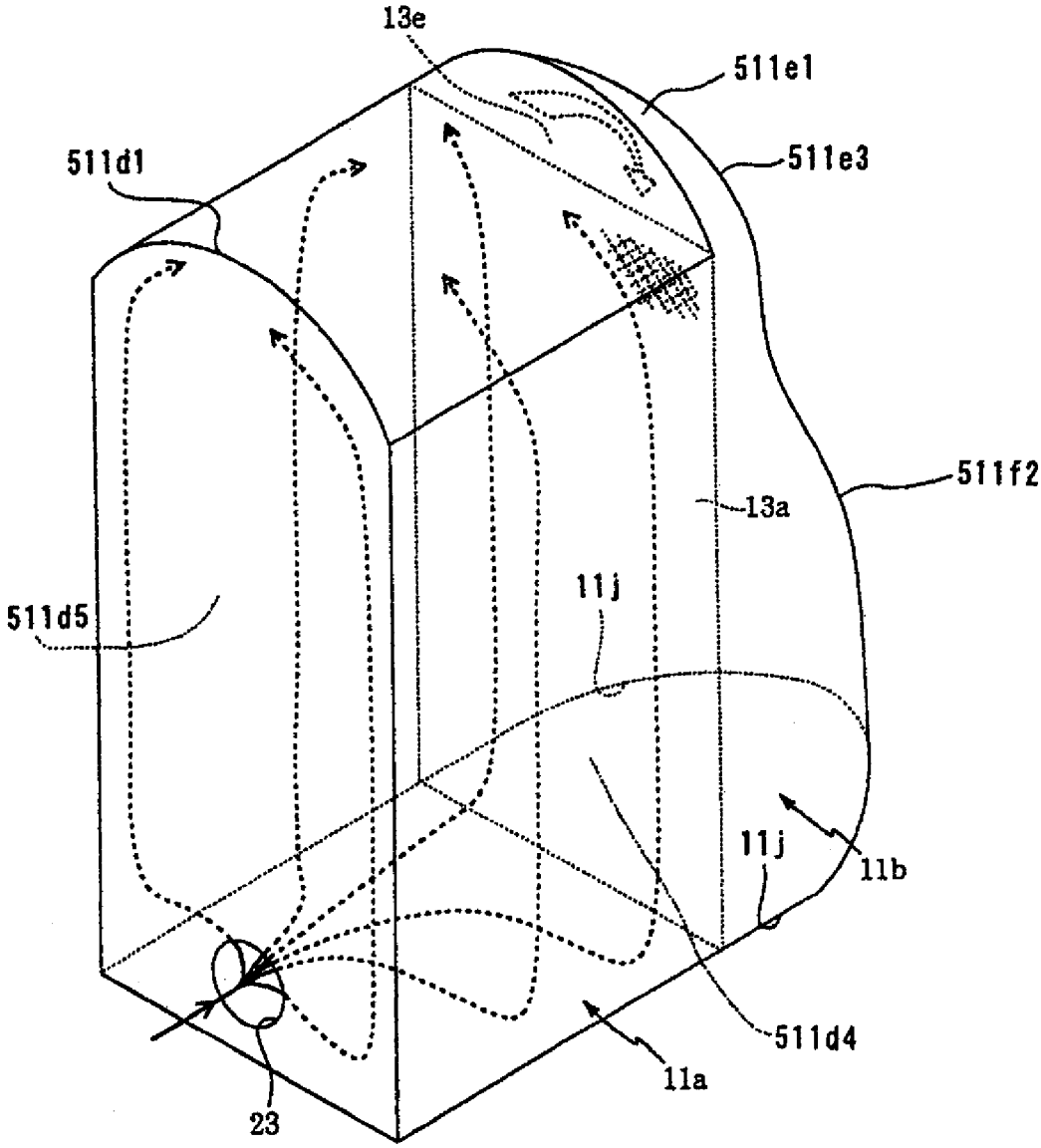
FIG. 24 is a perspective view showing air flow in the air trap unit of the eleventh embodiment of the invention.
Figure 25:
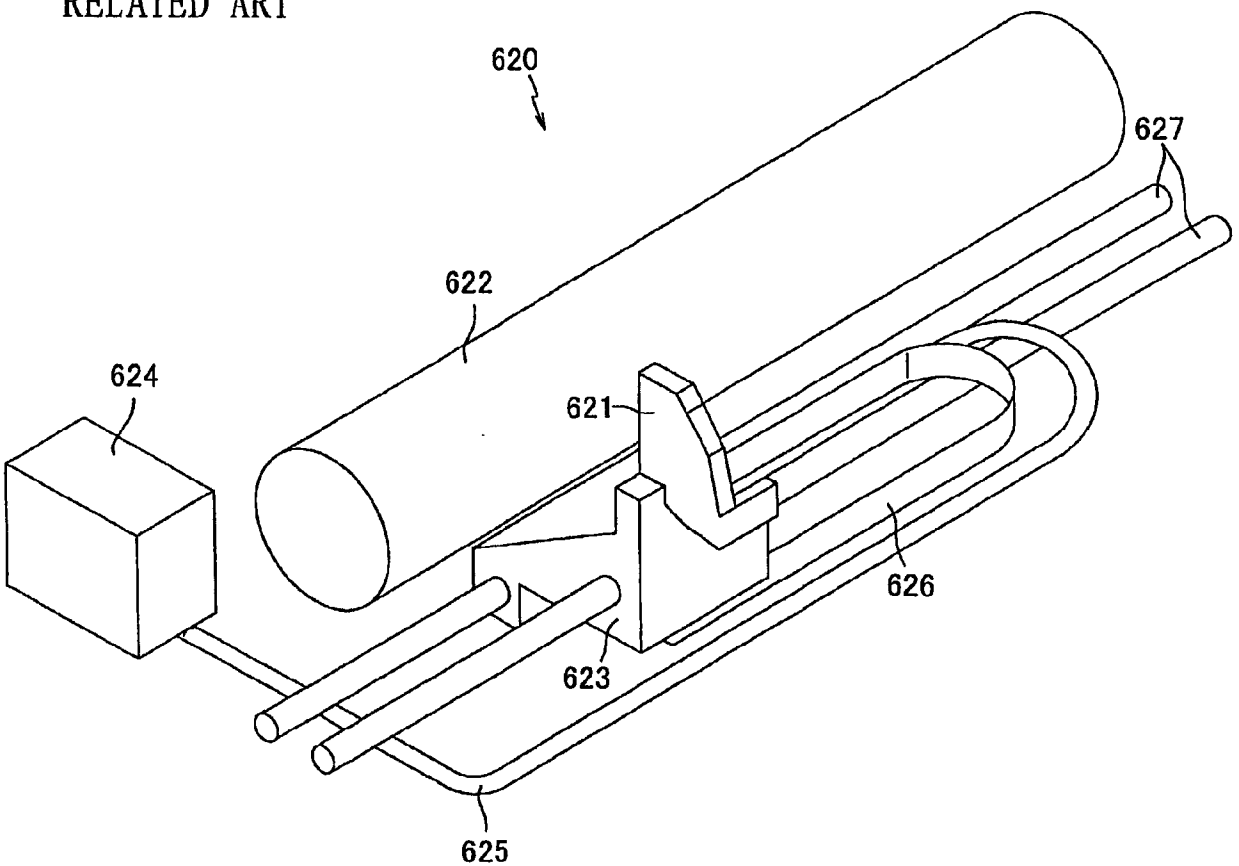
FIG.25 RELATED ART
FIG. 25 is a perspective view of a conventional ink jet printer.

Referring to FIG. 24, an air flow in the air trap chamber 30–33 is described below. Arrows in FIG. 24 show the flow of the air bubbles in the air trap chamber 30–33. Each of the air trap chambers 30–33 includes the ink inlet 23 through which ink is supplied from the corresponding ink tanks 4*a*–4*d*, the first filter 13*a* that separates the two chambers 11*a*, 11*b* and forms the opening 13*e* at the upper portion of the air trap chamber 30–33, and an ink outlet 24 (not shown in FIG. 24) from which the ink flows to the print head 15. The inner top surface 511*d*1 of the air trap chamber 30–33 is convex or curved upwardly. The second chamber 11*b* is fluidically connected to the first chamber 11*a*, so as to align the inner top surface 511*e*1 of the second chamber 11*b* with the inner top surface 511*d*1 of the first chamber 11*a*. The inner top surface 511*e*1 of the second chamber 11*b* is connected to the tapered inner side surface 511*f*2, which gradually becomes wider toward the bottom of the chamber 11*b*, so as to form the curved corner 511*e*3.

Ink supplied from the ink tank 4*a*–4*d* flows into the air trap chamber 30–33 through the ink inlet 23. The flow of the ink introduced into the first chamber 11*a* is blocked by the first filter 13*a*. The ink in the first chamber 11*a* flows into the second chamber 11*b*, through the opening 13*e* provided at the upper portion of the first filter 13*a*, and then into the print heads 15 through the ink outlet 24. As air is introduced into the ink tube 5*a*–5*d*, the air is delivered to the first chamber 11*a* together with ink supplied from the ink tank 4 through the ink tube 5*a*–5*d*. The air, in the ink, supplied to the first chamber 11*a* rises by its buoyancy to the upper portion of the air trap chamber 30–33, as shown by arrows with dotted lines in FIG. 24. The air goes up along inner surfaces 511*d*4, 511*d*5 of the first chamber 11*a* and is trapped in the inner top surface 511*d*1 of the first chamber 11*a*. Then, the air is carried by the ink flow into the second chamber 11*b* whose inner top surface 511*e*1 is aligned with the inner top surface 511*d*1 of the first chamber 11*a*.

The air trapped in the air trap chamber 30–33 is discharged from the ink outlet 24 by the purging operation. The upper corner 511*d*3 of the first chamber 11*a*, which is provided on the inner surface thereof on the side of the ink tank 4, is curved. The second chamber 11*b* is fluidically connected to the first chamber 11*a*, so as to align the inner top surface 511*e*1 of the second chamber 11*b* with the inner top surface 511*d*1 of the first chamber 11*a*. The inner top surface 511*e*1 of the second chamber 11*b* is connected to the tapered inner side surface 511*f*2, which gradually becomes wider toward the bottom of the chamber 11*b*, so as to form the curved corner 511*e*3. With this structure, stagnation points do not occur at the comers 511*d*3, 511*e*3 or the top inner surfaces 511*d*1, 511*e*1 of the air trap chamber 30–33, when air trapped in the chamber 30–33 is sucked during the purging operation from the first chamber 11*a*, toward the bottom of the second chamber 11*b*. Therefore, the air trapped in the air trap chamber 30–33 is discharged smoothly by the purging operation without leaving the air therein.

Although the inner top surface 511*d*1 of the first chamber 11*a* is convex or curved upwardly in the above-described eleventh embodiment, for example, the inner top surface may be formed to have a shape of triangle or trapezoid rising upwardly. Similar to the first chamber 11*a* having the inner top surface 511*d*1 in the eleventh embodiment, the triangular or trapezoidal chamber can trap air along an angled surface thereof, and the air can be discharged smoothly. The inner top surface 511*d*1 of the first chamber 11*a* is parallel to the bottom surface of the air trap unit 11. However, the air trap unit 11 may have an inner top surface angled upwardly toward the ink flow direction, that is, toward the second chamber 11*b*. Because air is trapped along the angled inner top surface, the air is discharged smoothly.

It should be understood that the invention is not limited in its application to the details of structure and arrangement of parts illustrated in the accompanying drawings. The invention is capable of other embodiments and of being practiced or performed in various ways without departing from the technical idea thereof, based on existing and well-known techniques among those skilled in the art.

What is claimed is:

1. An ink jet printer, comprising:

a print head that has at least one ink nozzle and performs printing to a recording medium by ejecting ink from the ink nozzle;

an ink tank that stores ink to be supplied to the print head;

an ink passage that is connected to the ink tank to supply ink from the ink tank;

an air chamber that is connected to the ink passage and the print head to store air generated in the ink passage;

a purge device that discharges the air stored in the air chamber from the ink nozzle; and a filter member that divides a lower portion of the air chamber into a first chamber at an ink tank side and a second chamber at a print head side, the filter member passes ink through when the print head performs printing, wherein an upper portion of the air chamber has less resistance to the ink flow than that of the filter member, the air is stored in a top portion of the air chamber when the print head performs printing and the air stored in the air chamber is discharged when the purge device generates an ink flow that goes over the filter member.

2. The ink jet printer according to claim 1, wherein the upper portion of the air chamber is an opening that communicates the first chamber and the second chamber.

3. The ink jet printer according to claim 1, further comprising a second filter that is connected to the filter member and the air chamber and has less resistance to the ink flow than that of the filter member, wherein the second filter divides the air chamber into the first and second chambers together with the filter member.

4. The ink jet printer according to claim 3, wherein the second filter extends from a top portion of the filter member.

5. The ink jet printer according to claim 1, wherein a volume of the second chamber is smaller than that of the first chamber.

6. The ink jet printer according to claim 1, wherein the first and second chambers are formed by more than two parts and the filter member is held between the parts.

7. The ink jet printer according to claim 1, wherein an inside of the second chamber is formed of a material having a better wettability than that of the first chamber.

8. The ink jet printer according to claim 1, wherein the ink tank is communicated with a bottom portion of the first chamber and the print head is communicated with a bottom portion of the second chamber.

9. The ink jet printer according to claim 1, further comprising a detecting device that detects whether a predetermined level of air is stored in the air chamber and a purge control device that operates the purge device when the detecting device detects the predetermined level of air is stored in the air chamber.

10. The ink jet printer according to claim 1, wherein an inside wall of a top portion of the first chamber is in a curved shape, a volume of which decreases toward the top portion and the top portion is connected to the second chamber.

11. The ink jet printer according to claim 1, wherein the air chamber is provided with a permanent air chamber that stores a certain amount of air after the purge device conducts a purge operation.

12. The ink jet printer according to claim 11, wherein the permanent air chamber is located above the ink flow generated by the purge device.

13. The ink jet printer according to claim 12, wherein the permanent air chamber is located at a top portion of the first chamber and is recessed from a top surface of the second chamber.

14. The ink jet printer according to claim 13, wherein the permanent air chamber is located above an ink inlet of the air chamber.

15. The ink jet printer according to claim 12, wherein the permanent air chamber is formed over an entire area of a top portion of the first chamber.

16. The ink jet printer according to claim 1, further comprising a guide wall that divides the first chamber but keeps a top portion of the first chamber open, wherein the guide wall guides pressure waves propagating from the ink passage to the top portion of the air chamber.

17. The ink jet printer according to claim 16, wherein the air chamber includes a third chamber formed by the guide wall, the third chamber is connected to the ink passage and a top portion of the third chamber communicates with the first chamber.

18. The ink jet printer according to claim 17, wherein the third chamber is located above an ink inlet of the air chamber.

19. The ink jet printer according to claim 18, wherein the guide wall has a height greater than a height of the filter member.

20. The ink jet printer according to claim 19, wherein the guide wall extends from a bottom of the air chamber to a point at a certain distance from a ceiling of the air chamber, the filter member is located substantially parallel to the guide wall at the other side of the first chamber, the ink inlet is located at a bottom of the third chamber and a bottom of the second chamber is connected to the print head.

21. The ink jet printer according to claim 16, further comprising a first detecting device that detects whether a predetermined level of air is stored in the air chamber, a second detecting device that detects whether ink is stored at a predetermined ink level and a purge control device that operates the purge device when the first detecting device detects the predetermined level of air is stored in the air chamber and stops the purging operation when the second detecting device detects that ink is stored at the predetermined ink level in the air chamber.

22. The ink jet printer according to claim 1, further comprising a plurality of the print heads, a plurality of the ink tanks, a plurality of the ink passages, a plurality of the air chambers, and a connecting member that is provided with a plurality of connecting ports, wherein each connecting port of the connecting member communicates with a corresponding ink passage.

23. The ink jet printer according to claim 22, wherein the connecting member is made of an elastic material.

24. The ink jet printer according to claim 23, wherein the air chambers are formed into one body.

25. The ink jet printer according to claim 22, wherein the filter member is provided to cover the plurality of air chambers.

26. The ink jet printer according to claim 1, further comprising a feed mechanism that opposes the print head and feeds the recording medium, wherein the filter member is placed substantially parallel to the recording medium fed by the feed mechanism.

27. The ink jet printer according to claim 1, further comprising a carriage on which the print head and the air chamber are mounted that moves along the recording medium, wherein the filter member is placed substantially parallel to the moving direction of the carriage.

28. The ink jet printer according to claim 27, wherein the first and second chambers are substantially perpendicular to the moving direction of the carriage.

29. The ink jet printer according to claim 28, wherein the air chamber is directly connected with the print head.

30. The ink jet printer according to claim 1, further comprising:

a first flexible wiring member that is connected with a driving element of the print head;

a body on which the print head is mounted;

a carriage on which the body is mounted that moves along the recording medium;

a control circuit that controls the driving element of the print head;

a second flexible wiring member that is connected with the first flexible wiring member and the control circuit; and an interface board that is connected with the first flexible wiring member and is placed substantially parallel to the body at a side of the air chamber opposite the print head, wherein the interface board connects the first and second flexible wiring members.

31. An ink jet printer, comprising:

a print head that has at least one ink nozzle and performs printing on a recording medium by ejecting ink from the ink nozzle;

an ink tank that stores ink to be supplied to the print head;

an ink passage that is connected to the ink tank to supply ink from the ink tank;

an air chamber that is connected to the ink passage and the print head to store air generated in the ink passage;

a purge device that discharges the air stored in the air chamber from the ink nozzle;

a wall that divides a lower portion of the air chamber into a first chamber at an ink tank side and a second chamber at a print head side in such a manner that the first and second chambers communicate at an upper portion of the air chamber;

an ink hole that is disposed on the wall; and a valve member that opens the ink hole to pass the ink supplied from the ink passage there through when the print head performs printing and closes the ink hole to cut the ink flow when the purge device conducts a purging operation, wherein the air stored in the air chamber is discharged when the purge device generates an ink flow that goes over the wall.

32. The ink jet printer according to claim 31, wherein the valve member does not close as a result of the ink flow generated when the print head performs printing.

33. The ink jet printer according to claim 32, wherein the valve member is disposed on the wall at the side of the first chamber and has a surface area larger than the ink hole that is configured to open the ink hole when the print head performs printing and close the ink hole when the purge device conducts the purging operation.

34. The ink jet printer according to claim 33, wherein the valve member that covers the ink hole at the side of the first chamber, is provided with a flexible portion of which outer portion moves along the wall and of which center portion moves toward the wall and at least one communication hole that is formed at a position of the flexible portion offset from the ink hole when the center portion of the flexible portion moves close to the wall, wherein the outer portion of the flexible portion bends so as to move the center portion of the flexible portion away from the wall, when the print head performs printing, to open the ink hole and to communicate the ink hole with the first chamber through the ink hole and communication hole, and wherein the outer portion of the flexible portion bends so as to move the center portion of the flexible portion closer to the wall, when the purge device conducts the purging operation, to close the ink hole and the at least one communication hole to cut off the communication between the ink hole and the first chamber.

35. The ink jet printer according to claim 32, wherein the valve member has:

a float member having a relative density less than that of ink and being larger than the ink hole; and a support member that supports the float member in the first chamber so that the float member contacts the ink hole.

36. The ink jet printer according to claim 31, wherein a volume of the second chamber is smaller than that of the first chamber.

37. The ink jet printer according to claim 31, wherein the first and second chambers are formed by more than two parts and the wall is held between the parts.

38. The ink jet printer according to claim 31, wherein an inside of the second chamber is formed of a material having a better wettability than that of the first chamber.

39. The ink jet printer according to claim 31, wherein the ink tank is communicated with a bottom portion of the first chamber and the print head is communicated with a bottom portion of the second chamber.

40. The ink jet printer according to claim 31, further comprising a detecting device that detects whether a predetermined level of air is stored in the air chamber and a purge control device that operates the purge device when the detecting device detects the predetermined level of air is stored in the air chamber.

41. The ink jet printer according to claim 31, wherein an inside wall of a top portion of the first chamber is in a curved shape of which volume decreases toward the top portion and the top portion is connected to the second chamber.

42. The ink jet printer according to claim 31, wherein the air chamber is provided with a permanent air chamber that stores a certain amount of air after the purge device conducts the purging operation.

43. The ink jet printer according to claim 42, wherein the permanent air chamber is located above the ink flow generated by the purge device.

44. The ink jet printer according to claim 43, wherein the permanent air chamber is located at a top portion of the first chamber and is recessed with respect to a top portion of the second chamber.

45. The ink jet printer according to claim 43, wherein the permanent air chamber is located above an ink inlet of the air chamber.

46. The ink jet printer according to claim 43, wherein the permanent chamber is formed by all of a top portion of the first chamber.

47. The ink jet printer according to claim 31, further comprising a guide wall that divides the first chamber but keeps the top portion of the first chamber open, wherein the guide wall guides pressure waves propagating from the ink passage to a top portion of the air chamber.

48. The ink jet printer according to claim 47, wherein the air chamber includes a third chamber formed by the guide wall, the third chamber is connected to the ink passage and a top portion of the third chamber communicates with the first chamber.

49. The ink jet printer according to claim 48, wherein the third chamber is located above an ink inlet of the air chamber.

50. The ink jet printer according to claim 49, wherein the guide wall extends from a bottom of the air chamber to a point at a certain distance from a ceiling of the air chamber, the wall is located substantially parallel to the guide wall at the other side of the first chamber, the ink inlet is located at a bottom of the third chamber and a bottom of the second chamber is connected to the print head.

51. The ink jet printer according to claim 48, wherein the guide wall is taller than the wall.

52. The ink jet printer according to claim 47, further comprising a first detecting device that detects whether a predetermined level of air is stored in the air chamber, a second detecting device that detects whether ink is stored at a predetermined ink level and a purge control device that operates the purge device when the first detecting device detects the predetermined level of air is stored in the air chamber and stops the purging operation when the second detecting device detects that ink is stored at the predetermined ink level in the air chamber.

53. The ink jet printer according to claim 31, further comprising a plurality of the print heads, a plurality of the ink tanks, a plurality of the ink passages, a plurality of the air chambers, and a connecting member that is provided with a plurality of connecting ports, wherein each connecting port of the connecting member is communicated with a corresponding ink passage.

54. The ink jet printer according to claim 53, wherein the connecting member is made of an elastic material.

55. The ink jet printer according to claim 54, wherein the air chambers are formed into one body.

56. An ink jet printer, comprising:

a print head that has at least one ink nozzle and performs printing to a recording medium by ejecting ink from the ink nozzle;

an ink tank that stores ink to be supplied to the print head;

an ink passage that is connected to the ink tank to supply ink from the ink tank;

an air chamber that is connected to the ink passage and the print head to store air generated in the ink passage;

a purge device that discharges the air stored in the air chamber from the ink nozzle; and a wall member that divides a lower portion of the air chamber into a first chamber at an ink tank side and a second chamber at a print head side, wherein the lower portion of the air chamber has greater resistance to the ink flow than that of an upper portion of the air chamber, an inside wall of a top portion of the first chamber is in a taper shape to have a decreasing volume toward the top portion, the top portion connected to the second chamber, and the air is stored in a top portion of the air chamber when the print head performs printing and the air stored in the air chamber is discharged when the purge device generates an ink flow that goes over the wall member.

57. The ink jet printer according to claim 56, wherein the upper portion of the air chamber is an opening that connects the first and second chambers and the wall member at the lower portion of the air chamber is provided with a filter.

58. The ink jet printer according to claim 57, wherein the first and second chambers are formed by more than two parts and the filter is held between the parts.

59. The ink jet printer according to claim 56, wherein a volume of the second chamber is smaller than that of the first chamber.

60. The ink jet printer according to claim 56, wherein the ink tank is communicated with a bottom portion of the first chamber and the print head is communicated with a bottom portion of the second chamber.

61. An ink jet printer, comprising:

a print head that has at least one ink nozzle and performs printing on a recording medium by ejecting ink from the ink nozzle;

an ink tank that stores ink to be supplied to the print head;

an ink passage that is connected to the ink tank to supply ink from the ink tank;

an air chamber that is connected to the ink passage and the print head to store air generated in the ink passage;

a purge device that discharges the air stored in the air chamber from the ink nozzle;

a wall member that divides a lower portion of the air chamber into a first chamber at an ink tank side and a second chamber at a print head side; and a permanent air chamber that stores a certain amount of air after the purge device operates, wherein the lower portion of the air chamber has a greater resistance to the ink flow than that of an upper portion of the air chamber, and wherein the air is stored in a top portion of the air chamber when the print head performs printing and the air stored in the air chamber is discharged so as to keep the certain amount of air stored in the permanent air chamber when the purge device generates an ink flow that goes over the wall member.

62. The ink jet printer according to claim 61, wherein the upper portion of the air chamber is an opening that connects the first and second chambers and the wall member at the lower portion of the air chamber is provided with a filter.

63. The ink jet printer according to claim 61, wherein the permanent air chamber is located above the ink flow generated by the purge device.

64. The ink jet printer according to claim 61, wherein the permanent air chamber is located at a top portion of the first chamber higher than the second chamber divided by the wall member.

65. An ink jet printer, comprising:

a print head that has at least one ink nozzle and performs printing on a recording medium by ejecting ink from the ink nozzle;

an ink tank that stores ink to be supplied to the print head;

an ink passage that is connected to the ink tank to supply ink from the ink tank;

an air chamber that is connected to the ink passage and the print head to store air generated in the ink passage;

a purge device that discharges the air stored in the air chamber from the ink nozzle; and a permanent air chamber that stores a certain amount of air after the purge device operates, wherein the permanent air chamber is located above the ink flow generated by the purge device, and the air is stored in a top portion of the air chamber when the print head performs printing and the air stored in the air chamber is discharged so as to keep the certain amount of air stored in the permanent chamber when the purge device generates an ink flow that goes over the wall member.

66. The ink jet printer according to claim 65, further comprising a wall member that divides a lower portion of the air chamber into a first chamber at an ink tank side and a second chamber at a print head side, wherein the lower portion of the air chamber has greater resistance to the ink flow than that of an upper portion of the air chamber, the upper portion of the air chamber is an opening that connects the first and second chambers and the wall member at the lower portion of the air chamber is provided with a filter, and the permanent air chamber is located at a top portion of the first chamber higher than the second chamber divided by the wall member.

67. An ink jet printer, comprising:

a print head that has at least one ink nozzle and performs printing on a recording medium by ejecting ink from the ink nozzle;

an ink tank that stores ink to be supplied to the print head;

an ink passage that is connected to the ink tank to supply ink from the ink tank;

an air chamber that is connected to the ink passage and the print head to store air generated in the ink passage;

a purge device that discharges the air stored in the air chamber from the ink nozzle;

a wall member that divides a lower portion of the air chamber into a first chamber at an ink tank side and a second chamber at a print head side; and a guide wall that divides the first chamber to create a third chamber but keeps a top portion of the first chamber open, wherein the lower portion of the air chamber has greater resistance to the ink flow than that of an upper portion of the air chamber, the air is stored in a top portion of the air chamber when the print head performs printing and the air stored in the air chamber is discharged when the purge device generates an ink flow that goes over the wall member, and the guide wall guides pressure waves propagating from the ink passage to the top portion of the air chamber.

68. The ink jet printer according to claim 67, wherein the guide wall has a height greater than a height of the wall member.

69. The ink jet printer according to claim 68, wherein the guide wall extends from a bottom of the air chamber to a point at a certain distance from a ceiling of the air chamber to divide the first chamber to create a third chamber, the wall member is located substantially parallel to the guide wall at the other side of the first chamber, an ink inlet is located at a bottom of the third chamber and a bottom of the second chamber is connected to the print head.

70. An ink jet printer, comprising:

a plurality of print heads, each print head having at least one ink nozzle to perform printing on a recording medium by ejecting ink from the ink nozzle;

a plurality of ink tanks that store ink to be supplied to the print heads;

a plurality of ink passages that are connected to respective ink tanks to supply ink from the ink tanks;

a plurality of air chambers that are connected to the respective ink passages and respective print heads to store air generated in the respective ink passages;

a purge device that discharges the air stored in the air chambers from the at least one ink nozzle of each print head;

a wall member that divides a lower portion of each air chamber into a first chamber at an ink tank side and a second chamber at a print head side; and a connecting member that is provided with a plurality of connecting ports, wherein the lower portion of the air chamber has greater resistance to the ink flow than an upper portion of the air chamber, the connecting ports of the connecting member are communicated with the respective ink passages, and the air is stored in a top portion of the air chamber when the print head performs printing and the air stored in each air chamber is discharged when the purge device generates an ink flow that goes over the wall member.

71. The ink jet printer according to claim 70, wherein the upper portion of the air chamber is an opening that connects the first and second chambers and the wall member at the lower portion of the air chamber is provided with a filter.

72. The ink jet printer according to claim 71, wherein the plurality of air chambers are formed into one body.

73. An ink jet printer, comprising:

a plurality of print heads, each print head having at least one ink nozzle to perform printing on a recording medium by ejecting ink from the at least one ink nozzle;

a plurality of ink tanks that each stores an ink to be supplied to a respective print head of the plurality of print heads;

a plurality of ink passages that are connected to respective ink tanks to supply ink from the respective ink tanks;

a plurality of air chambers that are connected to respective ink passages and associated print heads to store air generated in the ink passages, each air chamber divided into a first chamber and a second chamber by a wall member;

a purge device that discharges the air stored in the air chambers from the at least one ink nozzle of each print head; and a connecting member that is provided with a plurality of connecting ports, wherein the connecting ports of the connecting member are communicated with the respective ink passages, the air chambers are formed into one body, and the air is stored in a top portion of each air chamber when the print heads perform printing and the air stored in the air chambers is discharged when the purge device generates an ink flow that goes over the wall member.

74. The ink jet printer according to claim 73, wherein an upper portion of the air chamber is an opening that connects the first and second chambers and the wall member at a lower portion of the air chamber is provided with a filter.

75. The ink jet printer according to claim 73, wherein the first and second chambers are formed by more than two parts and the wall member is held between the parts.

76. An ink jet printer, comprising:

a plurality of print heads, each having at least one ink nozzle, to perform printing on a recording medium by ejecting ink from the ink nozzle;

a plurality of ink tanks, each ink tank storing an ink to be supplied to a print head of the plurality of print heads;

a plurality of ink passages that are connected to respective ink tanks to supply ink from the ink tanks;

a plurality of air chambers that are connected to respective ink passages and respective print heads to store air generated in the ink passages;

a purge device that discharges the air stored in each air chamber; and a connecting member that is provided with a plurality of connecting ports, wherein the connecting ports of the connecting member are communicated with the respective ink passages, and the air is stored in a top portion of each air chamber when the plurality of print heads perform printing and the air stored in the air chambers is discharged when the purge device generates an ink flow that goes faster than an ink flow generated when the print heads perform printing.

77. The ink jet printer according to claim 76, wherein the plurality of air chambers are formed into one body.

78. The ink jet printer according to claim 76, wherein the purge device discharges the air from the at least one ink nozzle of each print head.

79. An ink jet printer, comprising:

a plurality of print heads that have at least one ink nozzle each and perform printing on a recording medium by ejecting ink from the at least one ink nozzle;

a plurality of ink tanks that store ink to be supplied to respective print heads;

a plurality of ink passages that are connected to respective ink tanks to supply ink from the respective ink tanks;

a plurality of air chambers that are connected to respective ink passages and respective print heads to store air generated in the respective ink passages;

a purge device that discharges the air stored in each air chamber; and a connecting member that is provided with a plurality of connecting ports, wherein the plurality of the air chambers are formed into one body, and the air is stored in a top portion of each air chamber when the plurality of print heads perform printing and the air stored in the air chambers is discharged when the purge device generates an ink flow that goes faster than an ink flow generated when the print heads perform printing.

80. The ink jet printer according to claim 79, further comprising a wall member for each air chamber that divides a lower portion of the air chamber into a first chamber at an ink tank side and a second chamber at a print head side, wherein the lower portion of the air chamber has greater resistance to the ink flow than that of an upper portion of the air chamber, and the first and second chambers are formed by more than two parts and the wall member is held between the parts.

81. The ink jet printer according to claim 79, wherein the purge device discharges the air from the at least one ink nozzle of each print head.

82. An ink jet printer, comprising:

a print head that has at least one ink nozzle and performs printing on a recording medium by ejecting ink from the ink nozzle;

an ink tank that stores ink to be supplied to the print head;

an ink passage that is connected to the ink tank to supply ink from the ink tank;

an air chamber that is connected to the ink passage and the print head to store air generated in the ink passage;

a purge device that discharges the air stored in the air chamber;

a first flexible wiring member that is connected with a driving element of the print head;

a body on which the print head is mounted;

a carriage on which the body is mounted that moves along the recording medium;

a control circuit that controls the driving element of the print head;

a second flexible wiring member that is connected with the first flexible wiring member and the control circuit; and an interface board that is connected with the first flexible wiring member and is placed substantially parallel to the body at a side of the air chamber opposite to the print head, wherein the interface board connects the first and second flexible wiring members, and the air is stored in a top portion of the air chamber when the print head performs printing and the air stored in the air chamber is discharged when the purge device generates an ink flow that goes faster than an ink flow generated when the print head performs printing.

83. The ink jet printer according to claim 82, wherein the purge device discharges the air from the ink nozzle.

* * * * *